US011268517B2

(12) United States Patent
Kokubo et al.

(10) Patent No.: US 11,268,517 B2
(45) Date of Patent: Mar. 8, 2022

(54) PUMP AND IMPELLER WITH AUXILIARY BLADES ON THE UNDERSIDE OF THE IMPELLER AND A PERMANENT MAGNET ROTOR

(71) Applicant: NIDEC SANKYO CORPORATION, Nagano (JP)

(72) Inventors: Nobuki Kokubo, Nagano (JP); Hiroki Kuratani, Nagano (JP); Takashi Yamamoto, Nagano (JP); Masaki Harada, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 354 days.

(21) Appl. No.: 16/306,585

(22) PCT Filed: Apr. 5, 2018

(86) PCT No.: PCT/JP2018/014565
§ 371 (c)(1),
(2) Date: Dec. 3, 2018

(87) PCT Pub. No.: WO2018/190239
PCT Pub. Date: Oct. 18, 2018

(65) Prior Publication Data

US 2019/0162189 A1 May 30, 2019

(30) Foreign Application Priority Data

Apr. 10, 2017 (JP) ..... JP2017-077701

(51) Int. Cl.
*F04D 13/06* (2006.01)
*F04D 29/22* (2006.01)
*F04D 29/041* (2006.01)

(52) U.S. Cl.
CPC ..... *F04D 13/06* (2013.01); *F04D 29/041* (2013.01); *F04D 29/22* (2013.01); *F04D 29/2266* (2013.01)

(58) Field of Classification Search
None
See application file for complete search history.

(56) References Cited

U.S. PATENT DOCUMENTS 3,881,840 A * 5/1975 Bunjes ..... F04D 29/167 415/109
3,898,014 A * 8/1975 Meister ..... F04D 9/02 415/56.6

(Continued)

FOREIGN PATENT DOCUMENTS

CN 2314136 4/1999
CN 202266444 6/2012

(Continued)

OTHER PUBLICATIONS

"International Search Report (Form PCT/ISA/210)", dated Jun. 12, 2018, with English translation thereof, pp. 1-3.

(Continued)

*Primary Examiner* — Peter J Bertheaud
*Assistant Examiner* — Geoffrey S Lee
(74) *Attorney, Agent, or Firm* — JCIPRNET

(57) ABSTRACT

To provide a pump device configured such that the impeller can be prevented from being moved toward a case body by which a pump chamber is defined. An impeller is arranged in a pump chamber defined by a case body and an end wall portion of a motor. The impeller includes back blades protruding from a shroud toward the end wall portion of the motor. When the impeller is driven to circulate fluid through the pump chamber, a fluid is drawn out by the back blades from a clearance between the impeller and the end wall portion of the motor. Therefore, the impeller is moved by the (Continued)

negative pressure toward the end wall portion of the motor. The back blades function as a suction power generation mechanism configured to generate suction power sucking the impeller toward the end wall portion.

8 Claims, 13 Drawing Sheets

(56) References Cited

U.S. PATENT DOCUMENTS

| | | | | | |
|---|---|---|---|---|---|
| 4,883,403 | A * | 11/1989 | Walker | F04D 29/2266 | 415/98 |
| 5,411,367 | A * | 5/1995 | Walker | F04D 29/167 | 415/170.1 |
| 5,605,444 | A * | 2/1997 | Paton | F04D 29/2277 | 416/183 |
| 5,609,468 | A * | 3/1997 | Burgess | F04D 29/2266 | 415/171.1 |
| 7,329,085 | B2 * | 2/2008 | Walker | F04D 29/2266 | 415/87 |
| 8,439,642 | B2 * | 5/2013 | Scott | F04D 29/2288 | 416/183 |
| 9,673,678 | B2 * | 6/2017 | Okada | H02K 5/24 | |
| 9,876,414 | B2 * | 1/2018 | Yoshida | H02K 5/1732 | |
| 9,890,797 | B2 * | 2/2018 | Wilfley | F04D 29/266 | |
| 10,436,210 | B2 * | 10/2019 | Walker | F04D 29/2288 | |
| 2004/0136825 | A1 * | 7/2004 | Addie | F04D 29/4273 | 415/121.2 |
| 2010/0239417 | A1 * | 9/2010 | Scott | F04D 7/04 | 415/203 |
| 2011/0158795 | A1 * | 6/2011 | Burgess | F01D 5/143 | 415/191 |
| 2014/0064947 | A1 * | 3/2014 | Eriksson | F04D 1/04 | 415/203 |
| 2014/0072459 | A1 * | 3/2014 | Kalavsky | F04D 29/051 | 417/365 |
| 2015/0188383 | A1 * | 7/2015 | Okada | H02K 5/1732 | 310/43 |
| 2015/0229191 | A1 * | 8/2015 | Yoshida | H02K 5/1732 | 310/43 |

FOREIGN PATENT DOCUMENTS

| | | |
|---|---|---|
| CN | 204003597 | 12/2014 |
| CN | 204716606 | 10/2015 |
| CN | 205225856 | 5/2016 |
| JP | S55161992 | 12/1980 |
| JP | S57136895 U | 8/1982 |
| JP | S63125101 U | 8/1988 |
| JP | 2015108305 | 6/2015 |
| JP | 2016003580 | 1/2016 |

OTHER PUBLICATIONS

"Office Action of China Counterpart Application," with English translation thereof, dated Nov. 22, 2019, p. 1-p. 16.

* cited by examiner

PUMP AND IMPELLER WITH AUXILIARY BLADES ON THE UNDERSIDE OF THE IMPELLER AND A PERMANENT MAGNET ROTOR

CROSS-REFERENCE TO RELATED APPLICATION

This application is a 371 of international application of PCT application serial no. PCT/JP2018/014565, filed on Apr. 5, 2018, which claims the priority benefits of Japan application no. JP 2017-077701, filed on Apr. 10, 2017. The entirety of each of the abovementioned patent applications is hereby incorporated by reference herein and made a part of this specification.

TECHNICAL FIELD

The present invention relates to a pump device configured to drive an impeller in a pump chamber by a motor.

BACKGROUND ART

Japanese Unexamined Patent Application Publication No. 2016-3580 (hereinafter, referred to as Patent Literature 1) describes a pump device including a pump chamber provided with a fluid inlet port and a fluid outlet port, an impeller arranged in the pump chamber, and a motor configured to rotate the impeller. In the pump device according to Patent Literature 1, the motor includes a rotor, a cylindrical stator arranged at an outer peripheral side of the rotor, and a housing. The housing includes a partition wall member by which a space between the rotor and the stator is partitioned, and a resin sealing portion adapted to cover the stator from an outer peripheral side of the partition wall member. The pump chamber is defined by the housing and a case body provided on the housing to cover the housing. The fluid inlet port and the fluid outlet port are provided in the case body.

The rotor includes a cylindrical sleeve, a magnet arranged in an annular pattern at an outer peripheral side of the sleeve, and a holding member holding the sleeve and the magnet. A fixation shaft is inserted into the sleeve to extend through the sleeve, and the rotor is rotatably supported by the fixation shaft. A bearing member extending radially outward is attached to a halfway portion of the fixation shaft in an axial direction thereof. The bearing member functions as a thrust bearing, and the sleeve is brought into slidable contact with the bearing member from one side in the axial direction. The impeller is fixed to the holding member and located together with the rotor in the pump chamber.

CITATION LIST

Patent Literature

Patent Literature 1: Japanese Unexamined Patent Application Publication No. 2016-3580

SUMMARY OF THE INVENTION

Problems to be Solved by the Invention

When the motor operates to rotate the impeller, fluid flows from the fluid inlet port toward the fluid outlet port through the pump chamber. Here, the fluid passing the pump chamber flows into a gap between the impeller and the partition wall member; therefore, pressure in the gap increases. Consequently, a force moving the impeller toward the case body acts on the impeller. When the impeller is pressed toward the case body by such a force, the rotor (the sleeve) is pressed against the bearing member. As a result, high heat is generated between the bearing member and the rotor by a sliding movement. Accordingly, in a case where the sleeve and the holding member that configure the rotor are made of resin or in a case where the members by which the pump chamber is defined are made of resin, the resin members may be deformed by the generated heat.

Thus, in view of such a point, an object of the present invention is to provide a pump device configured such that when an impeller is driven by a motor to circulate fluid, the impeller can be prevented from being moved toward a case body by which a pump chamber is defined.

Means for Solving the Problem

In order to achieve the aforementioned object, a pump device according to the present invention includes a motor provided with an output shaft, a case body provided to cover an end wall portion located at an output side of the motor through which the output shaft extends, a pump chamber defined by the end wall portion and the case body, a fluid inlet port and an outlet port provided in the case body to be communicated with the pump chamber, an impeller attached to the output shaft to be arranged in the pump chamber, and a suction power generation mechanism configured to generate suction power sucking the impeller toward the end wall portion when the impeller is driven by the motor, and the fluid is flowing from the fluid inlet port toward the fluid outlet port through the pump chamber.

The pump device according to the present invention is configured such that when the impeller is driven by the motor, and the fluid is flowing from the fluid inlet port toward the fluid outlet port through the pump chamber, the suction power generation mechanism suctions the impeller toward the end wall portion of the motor. Accordingly, the fluid passing the pump chamber flows into a gap between the impeller and the end wall portion of the motor. Therefore, pressure in the gap increases and a force moving the impeller toward the case body acts on the impeller. Even in such a case, the force can be inhibited. Consequently, since the force pressing the output shaft to which the impeller is connected toward the case body can be inhibited, the rotor provided with the output shaft in the motor can be inhibited from being pressed against a bearing member that is slidably contactable with the rotor from the output side. As a result, heat generated by a sliding movement of the rotor with the bearing member can be inhibited.

According to the present invention, the impeller may include a shroud extending in a direction intersecting with an axis line of the output shaft, a front blade protruding from the shroud toward the opposite side of the end wall portion, and a back blade protruding from the shroud toward the end wall portion, and the suction power generation mechanism may include the back blade. If the impeller includes the back blade protruding from the shroud toward the end wall portion of the motor, the fluid drawn out radially outward from the gap between the impeller and the end wall portion may collide with the fluid flowing into the gap between the impeller and the end wall portion. Thus, since the fluid flowing into the gap between the impeller and the end wall portion is inhibited, the pressure in the gap can be inhibited from increasing. In addition, when the fluid is drawn out by the back blade radially outward from the gap between the impeller and the end wall portion, a negative pressure is generated between the impeller and the end wall portion. Therefore, the impeller can be sucked by the negative pressure toward the end wall portion of the motor. In other words, the back blade of the impeller configures the suction power generation mechanism configured to generate suction power sucking the impeller toward the end wall portion.

According to the present invention, in order to allow the fluid to be drawn out by the back blade radially outward from the gap between the impeller and the end wall portion when the impeller is driven to circulate the fluid through the pump chamber, the shroud may extend perpendicularly to the axis line, and the back blade may be configured such that a protrusion amount from the shroud toward the end wall portion is radially constant. In addition, a ring-shaped facing surface of the end wall portion overlapping a rotation trajectory of the back blade when viewed in the axis direction may be a flat surface in parallel with the back blade.

According to the present invention, the protrusion amount of the back blade may be equal to or greater than 50% of a separate distance between the shroud and the facing surface. With such a configuration, a distance between the back blade and the end wall portion of the motor can be reduced; therefore, the fluid can be easily drawn out by the back blade radially outward from the gap between the impeller and the end wall portion.

According to the present invention, a first distance between the back blade and the facing surface may be smaller than a second distance between the front blade and a case body side facing surface which faces the facing surface in the axis line in the case body. In other words, the distance between the back blade and the end wall portion of the motor is preferably smaller than the distance between the front blade and the case body. With such a configuration, negative pressure is easily generated between the back blade and the end wall portion of the motor.

According to the present invention, a plurality of the back blades may be provided at equal angular intervals around the axis line in order that the fluid is drawn out by the back blade radially outward from the gap between the impeller and the end wall portion.

According to the present invention, the impeller may include a cylindrical portion being coaxial with the axis line and protruding from the shroud toward the end wall portion, and a ring-shaped rib provided at a radially outer side of the cylindrical portion and coaxially with the cylindrical portion. The output shaft may be inserted to extend through a center hole of the cylindrical portion. The back blade may extend from an outer circumferential surface of the ring-shaped rib toward the radially outer side. A length dimension from the outer circumferential surface of the ring-shaped rib to a radially outer end in the back blade may be equal to or greater than a distance between the cylindrical portion and the ring-shaped rib. With such a configuration, the impeller can be held by the output shaft extending through the cylindrical portion so as not to be inclined. In addition, dusts or the like contained in the fluid can be prevented or inhibited from reaching the surroundings of the output shaft. In addition, since the length dimension from the outer circumferential surface of the ring-shaped rib to the radially outer end in the back blade is equal to or greater than the distance between the cylindrical portion and the ring-shaped rib, the radial length dimension of the back blade can be secured. Therefore, the fluid is easily drawn out by the back blade radially outward from the gap between the impeller and the end wall portion.

According to the present invention, the motor may include a rotor provided with the output shaft, and a bearing member supporting the output shaft so that the output shaft is rotatable. The bearing member may include a sliding surface with which the rotor is slidably contactable from the opposite side of the output side. The rotor may include a resin holding member holding the output shaft from a radially outer side, a magnet held by the holding member, a first metallic member fixed to the output shaft to extend from the output shaft toward the radially outer side and held by the holding member, a rotor-side sliding surface slidably contactable with the sliding surface, and a second metallic member held by the holding member in a state where the first metallic member is in contact with the second metallic member from the opposite side of the output side.

With such a configuration, the resin holding member holding the output shaft from the radially outer side holds the first metallic member fixed to the output shaft to extend from the output shaft toward the radially outer side. Therefore, a position of the holding member relative to the output shaft can be prevented or inhibited from changing in the axis line consequently, a position of the magnet held by the holding member can be prevented or inhibited from changing in the axis line and thus rotation accuracy of the rotor can be maintained. Further, since the first metallic member fixed to the output shaft is held by the holding member, heat generated by a sliding movement of the bearing member with the rotor can be released via the metallic member toward the output side. Therefore, the resin holding member can be prevented or inhibited from being deformed by the heat generated by the sliding movement of the bearing member with the rotor. Furthermore, since a portion of the rotor, which is slidable with the bearing member is the second metallic member, the portion slidable with the bearing member is not deformed by the heat generated by the sliding movement. Moreover, the first metallic member fixed to the output shaft is in contact with the second metallic member from the opposite side of the sliding surface. Therefore, even when the output shaft is moved toward the case body, the position of the second metallic member does not change in a direction to separate from the sliding surface in the axis line. Further, since the first metallic member is in contact with the second metallic member, the heat generated by the sliding movement of the bearing member with the rotor is released from the second metallic member via the first metallic member toward the output shaft.

Furthermore, the second metallic member is held by the holding member and is not fixed to the output shaft. Therefore, the second metallic member can be avoided from being deformed by fixation to the output shaft. As a result, flatness of the rotor-side sliding surface can be maintained and thus the rotation accuracy of the rotor is easily secured.

According to the present invention, the output shaft may be made of metal. With such a configuration, the heat generated by the sliding movement of the rotor with the bearing member is easily released via the output shaft.

Effect of the Invention

According to the present invention, the fluid is drawn out by the back blade of the impeller radially outward from the gap between the impeller and the end wall portion of the motor in the pump chamber. Therefore, pressure in the gap between the impeller and the end wall portion of the motor can be inhibited from increasing when the fluid passes the pump chamber to flow into the gap. Also, since the fluid is drawn out by the back blade of the impeller radially outward from the gap between the impeller and the end wall portion of the motor, a negative pressure is generated between the impeller and the end wall portion of the motor. The negative pressure is suction power moving the impeller toward the motor; therefore, the impeller is inhibited from being pressed toward the case body. Consequently, since the output shaft to which the impeller is connected is inhibited from being pressed toward the case body, the rotor provided with the output shaft in the motor can be inhibited from being pressed against the bearing member that is slidably contactable with the rotor from the output side. As a result, heat generated by a sliding movement of the rotor with the bearing member can be inhibited.

DESCRIPTION OF EMBODIMENTS

A pump device according to an embodiment of the present invention will be described herein with reference to the drawings.

(Pump Device)

Figure 1:
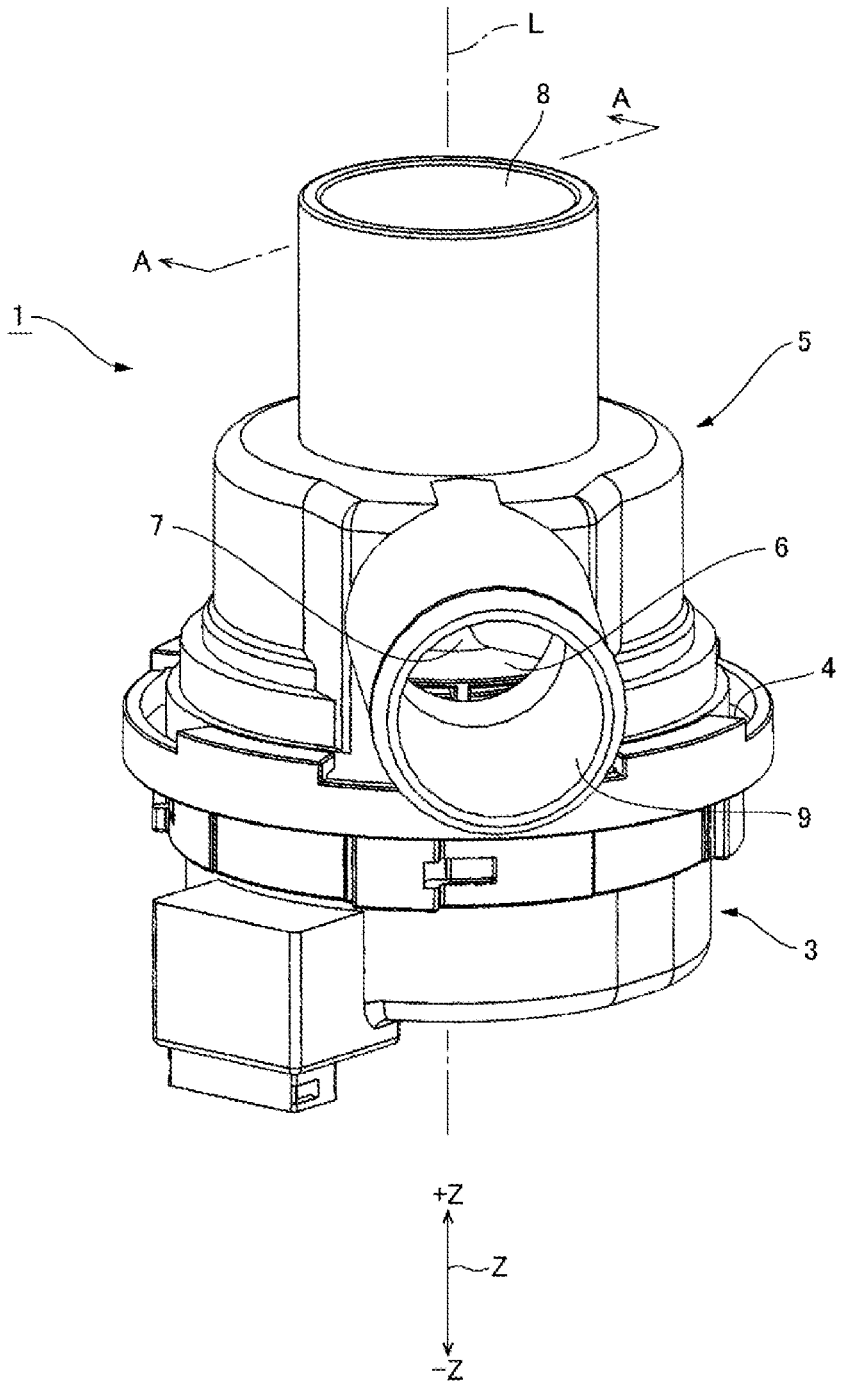
FIG. 1 is a perspective view of the appearance of a pump device according to an embodiment of the present invention.
Figure 2:
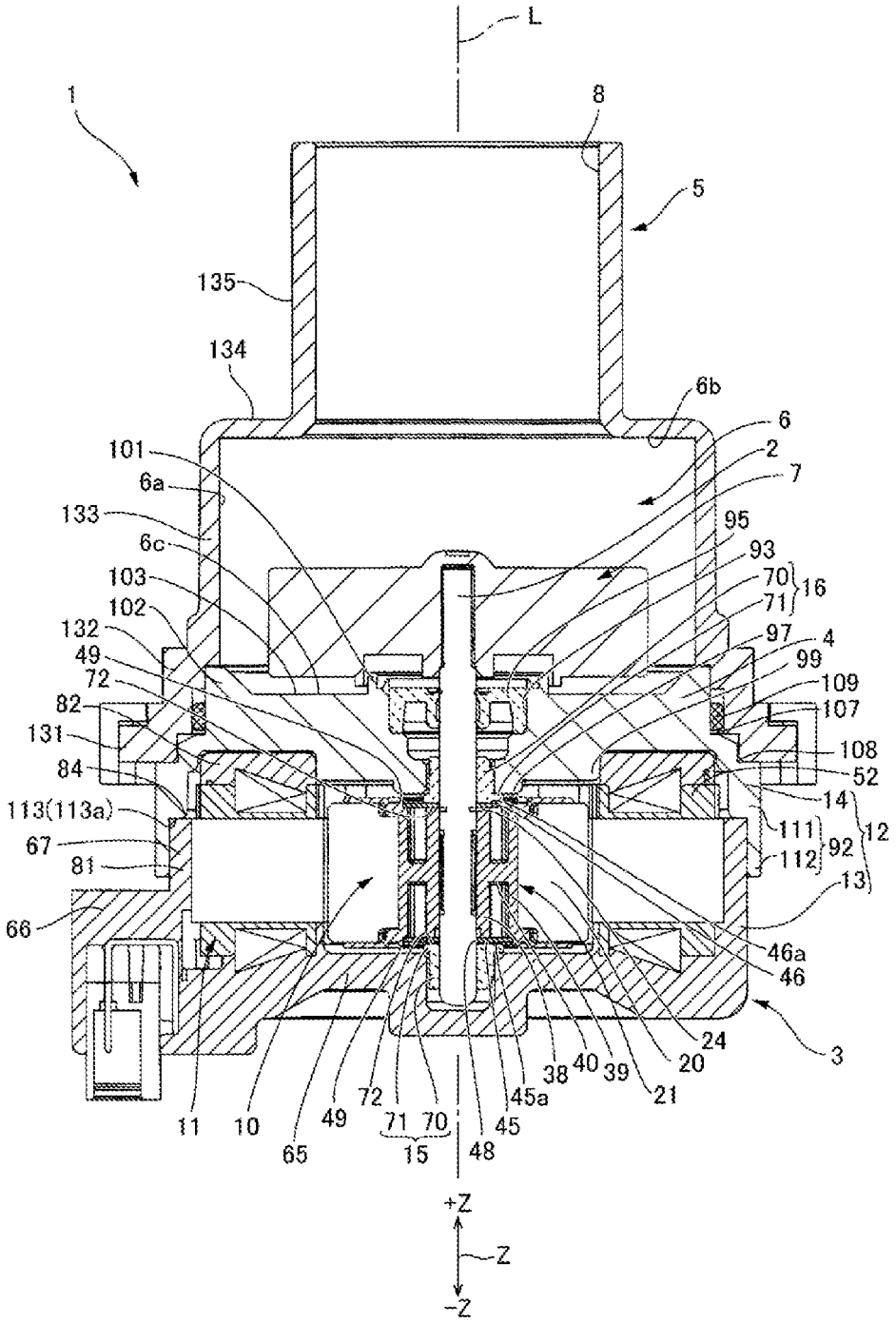
FIG. 2 is a cross-sectional view taken along the line A-A of the pump device in FIG. 1.
Figure 3:
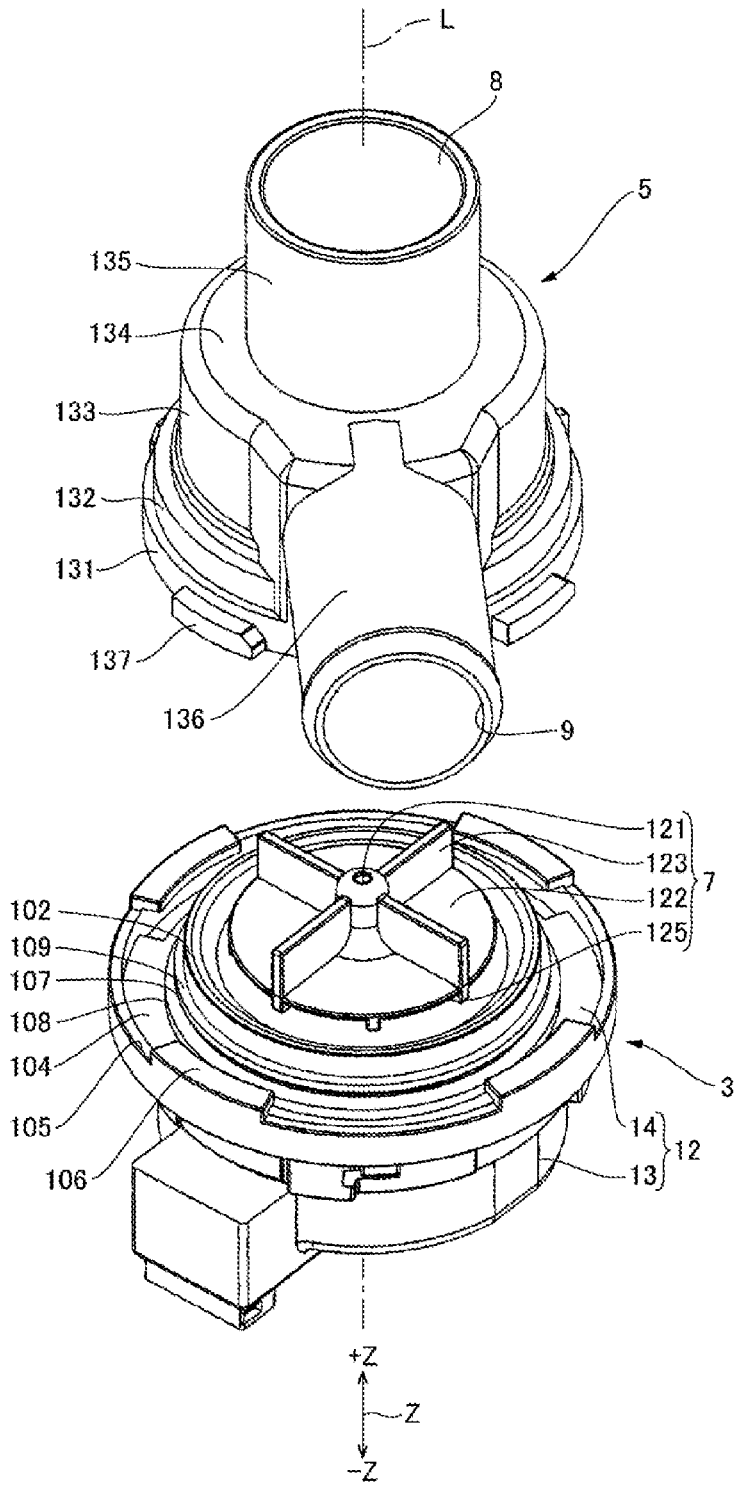
FIG. 3 is an exploded perspective view of the pump device as viewed from an output side of a motor.

FIG. 1 is a perspective view of the appearance of the pump device according to the embodiment of the present invention. FIG. 2 is a cross-sectional view taken along the line A-A of the pump device in FIG. 1. FIG. 3 is an exploded perspective view of the pump device as viewed from an output side of a motor. As illustrated in FIGS. 1, 2, and 3, a pump device 1 includes a motor 3 provided with an output shaft 2, a case body 5 provided on an end wall portion 4 to cover the end wall portion 4 located at an output side of the motor 3 from which the output shaft 2 protrudes, a pump chamber 6 defined by the end wall portion 4 of the motor 3 and the case body 5, and an impeller 7 attached to the output shaft 2 of the motor 3 and arranged in the pump chamber 6. The case body 5 includes a fluid inlet port 8 and a fluid outlet port 9 that are communicated with the pump chamber 6. The fluid inlet port 8 is formed coaxially with an axis line L of the output shaft 2. The fluid outlet port 9 is opened in a radial direction perpendicular to the axis line L.

The motor 3 is driven to rotate the impeller 7 and thereby fluid such as water sucked from the fluid inlet port 8 circulates through the pump chamber 6 to be discharged from the fluid outlet port 9. In the descriptions below, a direction of the axis line L of the output shaft of the motor configuring the pump device is defined as a Z-axis direction. A positive side in the Z-axis direction is located at the output side of the motor and is defined as an upper side for convenience in the specification. A negative side in the Z-axis direction is located on the opposite side of the output side of the motor and is defined as a lower side for convenience in the specification.

(Motor)

Figure 4:
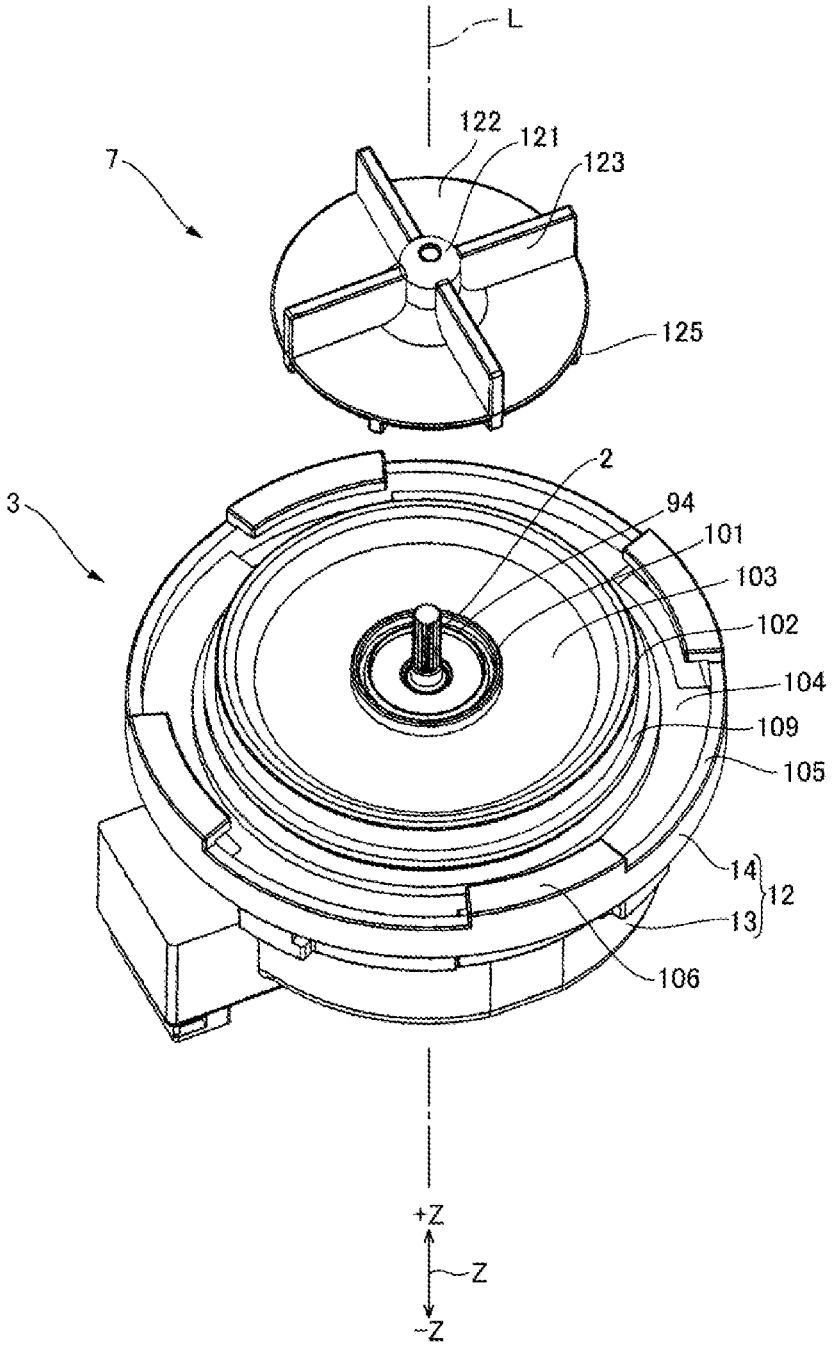
FIG. 4 is an exploded perspective view of the pump device from which a case body is removed as viewed from the output side of the motor.
Figure 5:
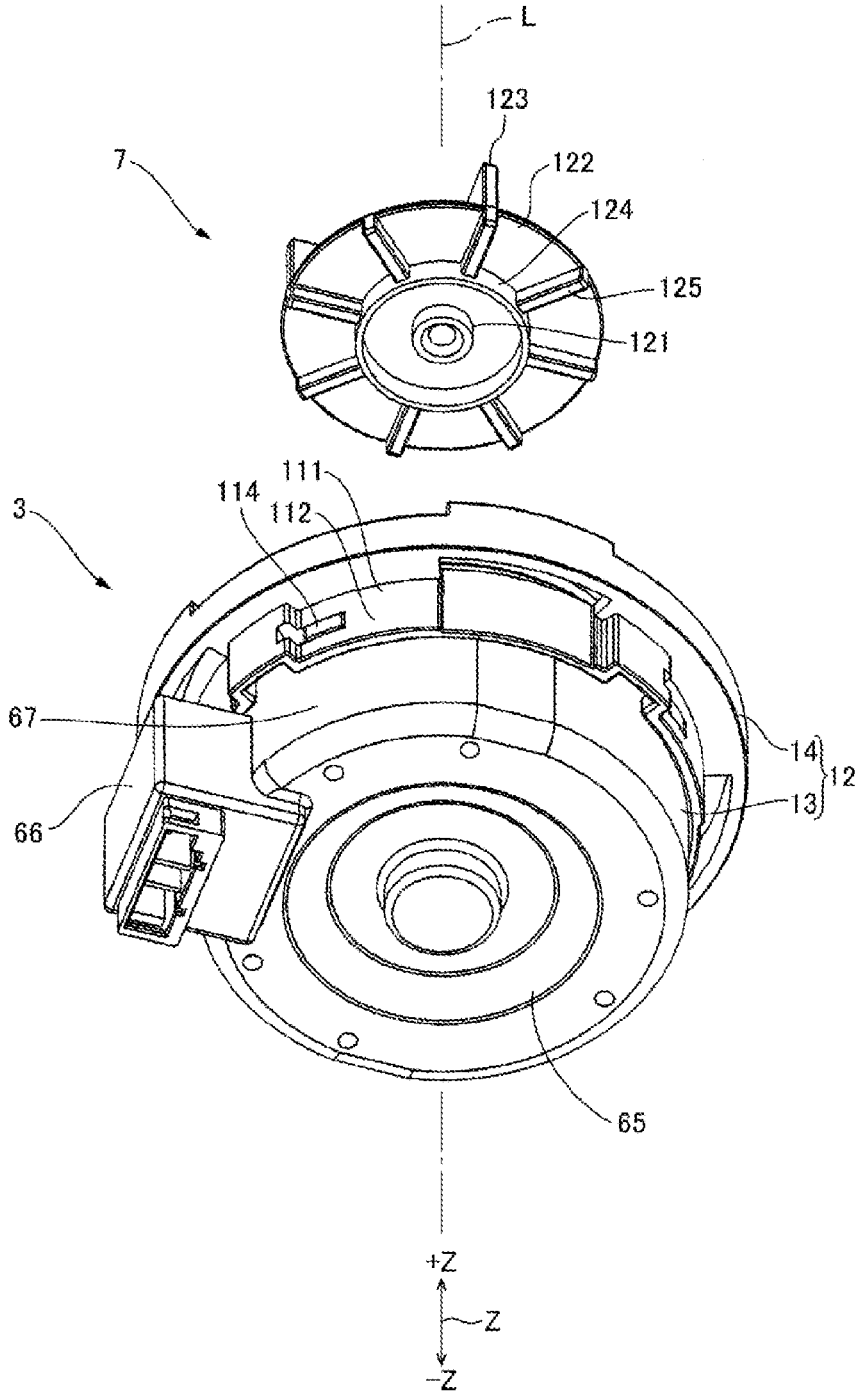
FIG. 5 is an exploded perspective view of the pump device from which the case body is removed as view from the opposite side of the output side of the motor.
Figure 6:
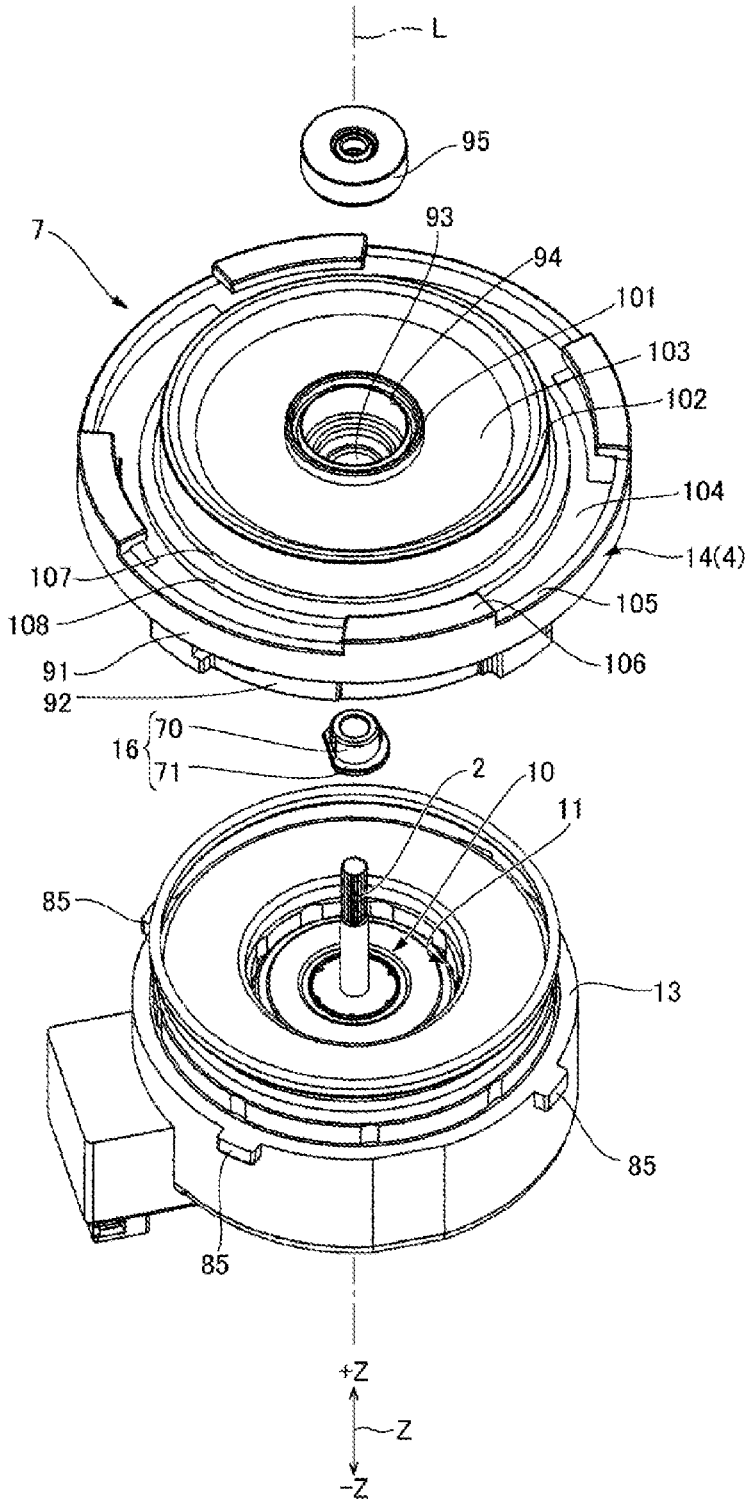
FIG. 6 is an exploded perspective view of the motor configured to drive an impeller as viewed from the output side.
Figure 7:
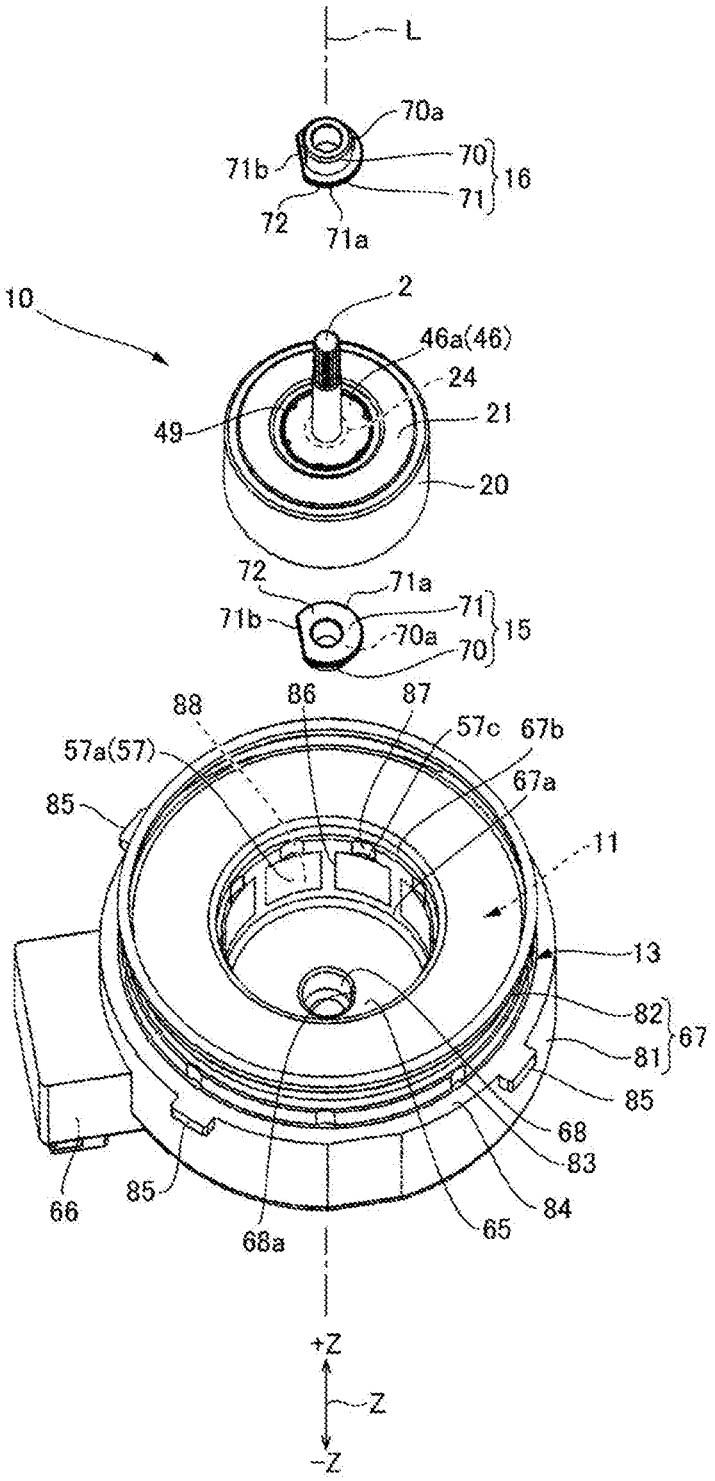
FIG. 7 is an exploded perspective view of the motor from which a cover member is removed.
Figure 8:
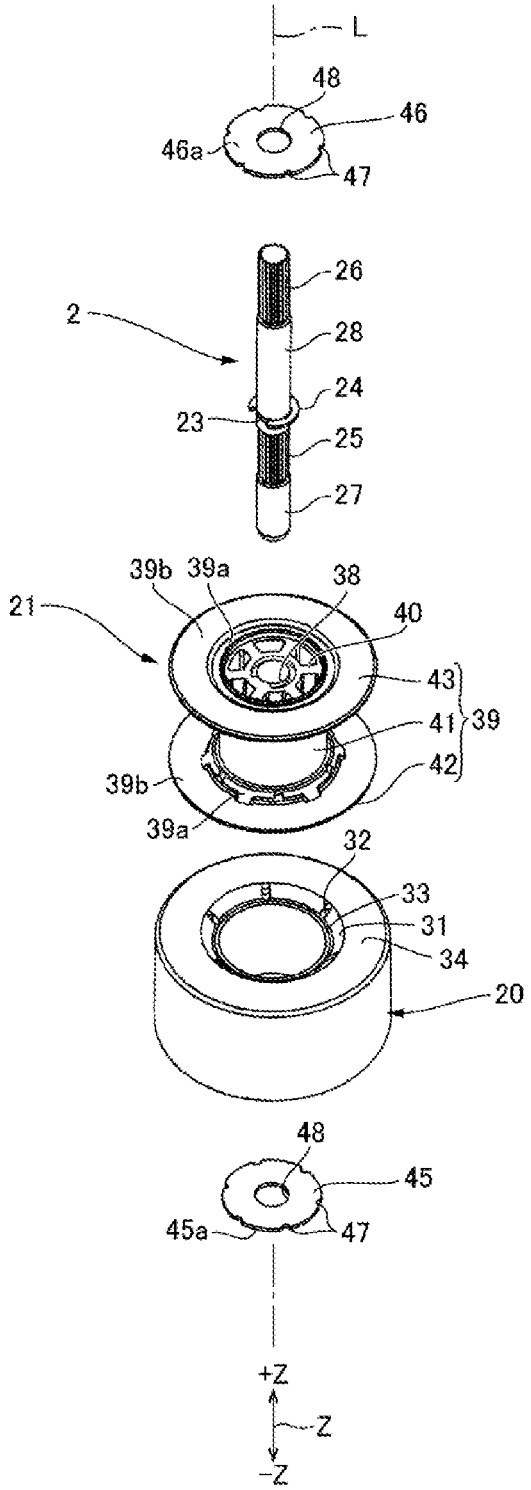
FIG. 8 is an exploded perspective view of a rotor.

FIG. 4 is an exploded perspective view of the pump device from which the case body is removed as viewed from the output side of the motor. FIG. 5 is an exploded perspective view of the pump device from which the case body is removed as view from the opposite side of the output side of the motor. FIG. 6 is a perspective view of the motor 3 from which a cover member 14 is removed. FIG. 7 is an exploded perspective view of the motor 3 from which the cover member 14 is removed. FIG. 8 is an exploded perspective view of a rotor.

The motor 3 is a DC brush-less motor. As illustrated in FIG. 6, the motor 3 includes a rotor 10, a stator 11, and a housing 12 for housing the rotor 10 and the stator 11. As illustrated in FIGS. 4 and 5, the housing 12 includes a resin sealing member 13 adapted to cover the stator 11 from the negative side in the Z-axis direction and a cover member 14 adapted to cover the resin sealing member 13 from the upper side. The cover member 14 configures the end wall portion 4 located at the output side of the motor 3 from which the output shaft 2 protrudes. As illustrated in FIG. 2, a first bearing member 15 is held by the resin sealing member 13. A lower end portion of the output shaft 2 is rotatably supported by the first bearing member 15. A second bearing member 16 is held by the cover member 14. An approximately middle portion of the output shaft 2 of the rotor 10 is rotatably supported by the second bearing member 16. The case body 5 is provided on the cover member 14 to cover the cover member 14 from the upper side.

(Rotor)

As illustrated in FIG. 7, the rotor 10 includes the output shaft 2, a magnet 20 surrounding the output shaft 2, and a holding member 21 adapted to hold the output shaft 2 and the magnet 20.

The output shaft 2 is made of metal and made of stainless steel in the embodiment. As illustrated in FIG. 8, the output shaft 2 includes a ring-shaped groove 23 located slightly lower than the center in the Z-axis direction. An E-ring 24 (a first metallic member) is attached to the ring-shaped groove 23. The E-ring 24 is a metallic plate-shaped member. The E-ring 24 is fixed to the ring-shaped groove 23 of the output shaft 2 to protrude radially outward from the output shaft 2. Also, the output shaft 2 includes a predetermined-length first knurling formed portion 25 located below the ring-shaped groove 23. Further, the output shaft 2 includes a predetermined-length second knurling formed portion 26 extending downward from an upper end of the output shaft 2. The second knurling formed portion 26 is a portion protruding upward from the housing 12 of the motor 3 to reach the pump chamber 6. The second knurling formed portion 26 is an attachment portion to which the impeller 7 is attached. A first supported portion 27 to be supported by the first bearing member 15 is provided below the first knurling formed portion 25 of the output shaft 2. A second supported portion 28 to be supported by the second bearing member 16 is provided between the ring-shaped groove 23 and the second knurling formed portion 26 of the output shaft 2.

The magnet 20 having a ring shape is arranged coaxially with the output shaft 2. The magnet 20 is arranged radially outward of the first knurling formed portion 25. North poles and south poles are alternately magnetized circumferentially on an outer circumferential surface of the magnet 20.

As illustrated in FIG. 8, a tapered surface 31 inclined downward radially inward and a ring-shaped surface 33 extending radially inward from a lower end of the tapered surface 31 are continuously provided at a radially inner end portion of an upper surface of the magnet 20. Further, in the same way as the upper surface, a tapered surface 31 inclined upward radially inward and a ring-shaped surface 33 extending radially inward from an upper end of the tapered surface 31 are continuously provided at a radially inner end portion of a lower surface of the magnet 20. Plural recesses 32 are formed circumferentially at equal angular intervals on each of the upper and lower tapered surfaces 31. An inner circumferential surface of each of the plural recesses 32 has a spherical shape. On the upper surface of the magnet 20, a ring-shaped surface 34 perpendicular to the axis line L is provided radially outward of the tapered surface 31. On the lower surface of the magnet 20, a ring-shaped surface 34 perpendicular to the axis line L is provided radially outward of the tapered surface 31.

The holding member 21 is a rein molded part and is configured to hold, from the radially outer side, a portion of the output shaft 2, which includes the first knurling formed portion 25. The holding member 21 includes a cylindrical output shaft holding portion 38, a ring-shaped magnet holding portion 39 arranged radially outward of the output shaft holding portion 38 to hold the magnet 20, plural connection portions 40 extending radially from the output shaft holding portion 38 to connect the output shaft holding portion 38 and the magnet holding portion 39.

The magnet holding portion 39 includes a magnet holding cylindrical portion 41 covering an inner circumferential surface 37 of the magnet 20 from a radially inner side, a ring-shaped first magnet holding flange portion 42 extending outward from a lower end of the magnet holding cylindrical portion 41, and a ring-shaped second magnet holding flange portion 43 extending outward from an upper end of the magnet holding cylindrical portion 41. As illustrated in FIG. 7, the first magnet holding flange portion 42 covers a lower surface portion of the magnet 20 excluding an outer circumferential rim portion of the lower surface of the magnet 20. The second magnet holding flange portion 43 covers an upper surface portion of the magnet 20 excluding an outer circumferential rim portion of the upper surface of the magnet 20. Also, as illustrated in FIG. 8, each of the first magnet holding flange portion 42 and the second magnet holding flange portion 43 includes a tapered surface covering portion 39*a* covering the tapered surface 31 and a ring-shaped plate portion 39*b* located radially outward of the tapered surface covering portion 39*a* to overlap the ring-shaped surface 34. The tapered surface covering portion 39*a* has thickness larger in the Z-axis direction than that of the ring-shaped plate portion 39*b*. In addition, the first magnet holding flange portion 42 and the second magnet holding flange portion 43 are respectively formed along the lower surface and the upper surface of the magnet 20 and are closely in contact with the inner circumferential surfaces of the recesses 32.

Here, the E-ring 24 fixed to the output shaft 2 is held by the holding member 21 in a state where a portion of the E-ring 24, which protrudes radially outward from the output shaft 2 is embedded into an upper surface of the output shaft holding portion 38. The E-ring 24 is provided such that an upper surface of the portion protruding radially outward from the output shaft 2 is exposed upward from the output shaft holding portion 38. The upper surface of the E-ring 24, the upper surface of the output shaft holding portion 38, and the upper surfaces of the connection portions 40 are located on the same plane perpendicular to the axis line L.

Next, the rotor 10 includes a first bearing plate 45 held at a lower end of the holding member 21 and a second bearing plate 46 (a second metallic member) held at an upper end of the holding member 21. Each of the first bearing plate 45 and the second bearing plate 46 is a ring-shaped metallic plate. An outer circumferential rim of each of the first bearing plate 45 and the second bearing plate 46 includes plural cut portions 47. Thus, the outer circumferential rim of each of the first bearing plate 45 and the second bearing plate 46 includes protruded and recessed portions.

The six cut portions 47 are formed at equal angular intervals. The cut portions 47 formed in each of the first bearing plate 45 and the second bearing plate 46 are respectively disposed opposed to the connection portions 40 in the Z-axis direction. The first bearing plate 45 is fixed to the holding member 21 in a state where the output shaft 2 extends through a center hole 48 of the first bearing plate 45, therefore covering the connection portions 40 and the output shaft holding portion 38 from the lower end of the holding member 21. As illustrated in FIG. 2, a lower surface of the first bearing plate 45 is disposed perpendicular to the axis line L in a state where the first bearing plate 45 is fixed to the holding member 21. The second bearing plate 46 is fixed to the holding member 21 in a state where the output shaft 2 extends through a center hole 48 of the second bearing plate 46, therefore covering the connection portions 40, the output shaft holding portion 38, and the E-ring 24 from the upper side of the holding member 21. The second bearing plate 46 is in plane contact with the E-ring 24 in a state where the second bearing plate 46 is fixed to the holding member 21. An upper surface of the second bearing plate 46 is disposed perpendicular to the axis line L. The upper surface of the second bearing plate 46 is a rotor-side sliding surface 46*a* slidably contactable with the second bearing member 16 from the lower side.

Here, the holding member 21 is to be formed by insert molding where the output shaft 2 to which the E-ring 24 is attached and the magnet 20 are arranged in a die and resin is injected into the die. After insert molding, the second bearing plate 46 and the first bearing plate 45 are held by the holding member 21.

To make the first bearing plate 45 held by the holding member 21, the output shaft 2 is inserted through the center hole 48 of the first bearing plate 45; thereafter, the first bearing plate 45 is overlapped with the connection portions 40 at the lower end of the holding member 21 and with the output shaft holding portion 38 at the lower end of the holding member 21. Afterward, a portion of the holding member 21, located radially outward of the first bearing plate 45 is plastic deformed by heat, thereby covering an outer circumferential portion of the lower surface of the first bearing plate 45. In addition, the resin is filled into the cut portions 47. Thus, a ring-shaped plastic deformed portion 49 covering the outer circumferential rim of the first bearing plate 45 from the lower side and the radially outer side is formed on a lower surface of the holding member 21. The first bearing plate 45 is held by the connection portions 40 at the lower end of the holding member 21, the output shaft holding portion 38 at the lower end of the holding member 21, and the plastic deformed portion 49.

Likewise, to make the second bearing plate 46 held by the holding member 21, the output shaft 2 is inserted through the center hole 48 of the second bearing plate 46; thereafter, the second bearing plate 46 is overlapped with the connection portions 40 at the upper end of the holding member 21 and with the output shaft holding portion 38 at the upper end of the holding member 21. In addition, a lower surface of the second bearing plate 46 is brought in plane contact with the upper surface of the E-ring 24. Afterward, a portion of the holding member 21, located radially outward of the second bearing plate 46 is plastic deformed by heat, thereby covering an outer circumferential portion of the upper surface of the second bearing plate 46. In addition, the resin is filled into the cut portions 47. Thus, as illustrated in FIG. 7, a ring-shaped plastic deformed portion 49 covering the outer circumferential rim of the second bearing plate 46 from the upper side and the radially outer side is formed on an upper surface of the holding member 21. The second bearing plate 46 is held by the connection portions 40 at the upper end of the holding member 21, the output shaft holding portion 38 at the upper end of the holding member 21, the upper surface of the E-ring 24, and the plastic deformed portion 49.

(Stator)

Figure 9:
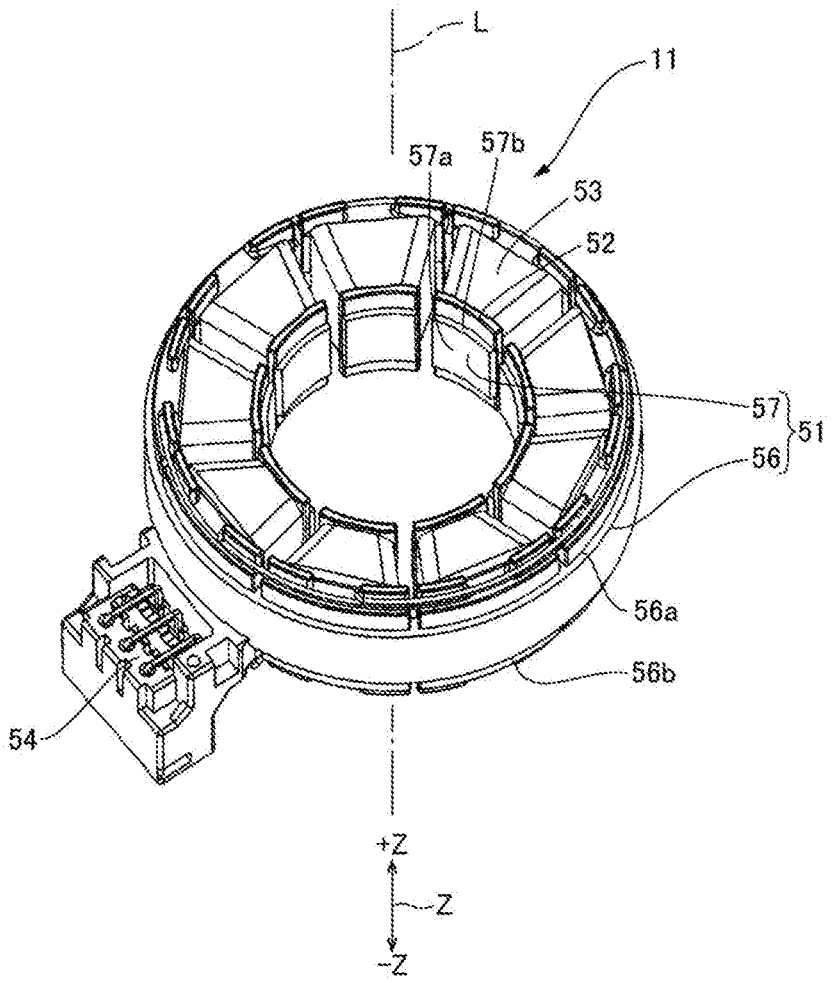
FIG. 9 is a perspective view of a stator.

FIG. 9 is a perspective view of the stator 11. The stator 11 includes a ring-shaped stator core 51 located radially outward of the rotor 10, plural coils 53 wound via insulators 52 on the stator core 51, and a connector 54 configured to connect power feeding wires for supplying power to the respective coils 53.

The stator core 51 is a laminated core formed of laminated thin magnetic plates made of magnetic material. As shown in FIG. 9, the stator core 51 is provided with a ring-shaped portion 56 and plural salient pole portions 57 protruding radially inward from the ring-shaped portion 56. The plural salient pole portions 57 are formed at equal angular pitches and are arranged circumferentially at a constant pitch. In the embodiment, the plural salient pole portions 57 are formed at an angular pitch of 40 degrees around the axis line L as the center. Therefore, the stator core 51 is provided with the nine salient pole portions 57. An inner circumferential end surface 57*a* of each of the salient pole portions 57 is a circular arc surface around the axis line L as the center, and the inner circumferential end surface 57*a* is disposed to face the outer circumferential surface of the magnet 20 of the rotor 10 while being slightly spaced apart from the outer circumferential surface of the magnet 20.

Each of the insulators 52 is formed of insulating material such as resin. Each of the insulators 52 is formed in a tubular shape with flanges, which is provided with flange portions at opposite ends in a radial direction. The insulator 52 is attached to the salient pole portion 57 so that an axial direction of the insulator 52 formed in a tubular shape coincides with a radial direction of the stator 11. The coils 53 are respectively wound around the plural salient pole portions 57 via the insulators 52. As illustrated in FIG. 2, each coil 53 wound around the insulator 52 protrudes radially outward and extends in the Z-axis direction. Also, an upper surface of the ring-shaped portion 56 of the stator core 51 is partially covered by the insulators 52, meanwhile an outer circumferential rim 56*a* of the upper surface of the ring-shaped portion 56 is not covered by the insulators 52. Similarly, a lower surface of the ring-shaped portion 56 of the stator core 51 is partially covered by the insulators 52, meanwhile an outer circumferential rim 56*b* of the lower surface of the ring-shaped portion 56 is not covered by the insulators 52.

A tip end portion of each salient pole portion 57 protrudes radially inward from the insulator 52. A portion of the salient pole portion 57, which is exposed radially inward from the insulator 52 (a portion between the inner circumferential end surface 57*a* and a portion around which the coil 53 is wound) is provided with an axial end surface 57*b* perpendicular to the axis line L. One of the plural insulators 52 is integrally formed with the connector 54 with which the power feeding wires for supplying power to the coils 53 are detachably connected.

(Resin Sealing Member)

As illustrated in FIGS. 5 and 7, the resin sealing member 13 includes a disk-shaped sealing member bottom portion 65 adapted to cover the coils 53, the insulators 52, and the stator core 51 from the lower side. Further, the resin sealing member 13 includes a sealing member projecting portion 66 extending radially outward from the sealing member bottom portion 65 to cover the connector 54, and a sealing member cylindrical portion 67 extending upward from the sealing member bottom portion 65 to cover the coils 53, the insulators 52, and the stator core 51.

As illustrated in FIG. 7, a bearing member holding recess 68 is provided in the center on an upper surface of the sealing member bottom portion 65. The first bearing member 15 located below the magnet 20 to support the rotor 10 so that the rotor 10 is rotatable is held by the bearing member holding recess 68. The bearing member holding recess 68 is a circular recessed portion provided with a groove 68*a* that is provided in a circumferential portion of an inner circumferential surface of the recessed portion to extend in the Z-axis direction.

The first bearing member 15 made of resin includes a cylindrical support portion 70 having a through hole through which the output shaft 2 extends, and a flange portion 71 extending radially outward from an upper end of the support portion 70. A protruded portion 70*a* extending with a constant width in the Z-axis direction is formed on a circumferential portion of an outer circumferential surface of the support portion 70. When viewed in the Z-axis direction, the outline of the flange portion 71 has a D-shape provided with a circular arc outline portion 71*a* of a circular arc shape and a linear outline portion 71*b* linearly connecting one circumferential end of the circular arc outline portion 71*a* to the other circumferential end of the circular arc outline portion 71*a*. The linear outline portion 71*b* is located on the opposite side of the through hole from the protruded portion 70*a*.

The support portion 70 of the first bearing member 15 is inserted into the bearing member holding recess 68 in a state where the protruded portion 70*a* of the support portion 70 is aligned with the position of the groove 68*a* of the bearing member holding recess 68. Then, as illustrated in FIG. 2, the first bearing member 15 is inserted until the flange portion 71 is brought into contact with the sealing member bottom portion 65 from the upper side, therefore being fixed to the bearing member holding recess 68. In a state where the first bearing member 15 is fixed to the bearing member holding recess 68, an upper end surface of the flange portion 71 is perpendicular to the axis line L. Here, the support portion 70 function as a radial bearing for the output shaft 2, and the flange portion 71 functions as a thrust bearing for the rotor 10. In other words, the upper end surface of the flange portion 71 is a sliding surface 72 with which the rotor 10 is slidably contactable. The sliding surface 72 of the first bearing member 15 is slidably contactable with the lower surface of the first bearing plate 45 fixed to the holding member 21 of the rotor 10. In other words, the lower surface of the first bearing plate 45 is a rotor-side sliding surface 45*a* slidably contactable with the sliding surface 72 of the first bearing member 15. In addition, grease is applied to the sliding surface 72.

Next, as illustrated in FIG. 7, as viewed from the lower side to the upper side, the sealing member cylindrical portion 67 includes a large-diameter cylindrical portion 81 and a small-diameter cylindrical portion 82 that has an outer diameter smaller than an outer diameter of the large-diameter cylindrical portion 81. The outer diameter of the large-diameter cylindrical portion 81 is larger than an outer diameter of the ring-shaped portion 56 of the stator core 51, and the outer diameter of the small-diameter cylindrical portion 82 is smaller than the outer diameter of the ring-shaped portion 56 of the stator core 51.

Openings 83 allowing the outer circumferential rim 56*a* of the stator core 51 to be exposed upward from the resin sealing member 13 are provided in a boundary portion between the large-diameter cylindrical portion 81 and the small-diameter cylindrical portion 82 of the sealing member cylindrical portion 67. Further, a ring-shaped end surface 84 perpendicular to the axis line L is provided radially outward of the openings 83 of the resin sealing member 13. The outer circumferential rim of the stator core 51 exposed from the openings 83 and the ring-shaped end surface 84 are located on the same plane perpendicular to the axis line L. Four engagement projections 85 located at equal angular intervals and extending radially outward are provided at an upper end portion of the large-diameter cylindrical portion 81.

As viewed from the lower side to the upper side, an inner circumferential surface of the sealing member cylindrical portion 67 is provided with a small-diameter inner circumferential surface portion 67*a* and a large-diameter inner circumferential surface portion 67*b* that has an inner diameter larger than an inner diameter of the small-diameter inner circumferential surface portion 67*a*. A curvature radius of the small-diameter inner circumferential surface portion 67*a* is equal to a curvature radius of the inner circumferential end surface 57*a* of the salient pole portion 57. Plural openings 86 allowing the inner circumferential end surfaces 57*a* of the respective salient pole portions 57 of the stator core 51 to be exposed radially inward are provided in the small-diameter inner circumferential surface portion 67*a*. Further, cut portions 87 allowing the axial end surfaces 57*b* of the respective salient pole portions 57 to be partially exposed upward are formed in the small-diameter inner circumferential surface portion 67*a*. In other words, the nine cut portions 87 are formed in the small-diameter inner circumferential surface portion 67*a* at an angular pitch of 40 degrees around the axis line L as the center. Each of the cut portions 87 is a groove extending from a rim of each of the openings 86 to an upper edge of the small-diameter inner circumferential surface portion 67*a* in the Z-axis direction. A cross-sectional shape of the cut portion 87 is a circular arc. Since the plural cut portions 87 are provided, a center portion in the circumferential direction of a tip end portion of the axial end surface 57*b* of each of the salient pole portions 57 is formed as an exposed portion 57*c* exposed upward.

The inner circumferential end surface 57*a* of each of the salient pole portions 57, which is exposed from the opening 86 is disposed continuously with the small-diameter inner circumferential surface portion 67*a* without a step. An anti-rust agent 88 is applied to the inner circumferential end surface 57*a* of each of the salient pole portions 57, which is exposed from the opening 86. Also, the anti-rust agent 88 is applied to the exposed portion 57*c* of the axial end surface 57*b* of each of the salient pole portions 57, which is exposed from the cut portion 87. In the embodiment, an epoxy paint is used as the anti-rust agent 88. Alternatively, a paint other than an epoxy paint, a rust preventive oil, or an adhesive may be used as the anti-rust agent 88.

The resin sealing member 13 is formed of BMC (Bulk Molding Compound). In the embodiment, the stator 11 is disposed in a die and resin is injected into the die to be cured; thereby, the resin sealing member 13 is formed. In other words, the resin sealing member 13 is integrally molded with the stator 11 by insert molding.

Here, in the embodiment, the inner circumferential end surface 57*a* of each of the salient pole portions 57 is exposed from the resin sealing member 13. Thus, a die portion having a circular column shape is provided in the die for insert molding. An outer circumferential surface of the die portion is brought into contact with the inner circumferential end surface of each of the salient pole portions 57, and thereby the stator core 51 can be positioned in the radial direction. Further, the resin sealing member 13 is disposed such that a portion (the exposed portion 57*c*) of the axial end surface 57*b* of each of the salient pole portions 57 of the stator core 51 is exposed upward. Furthermore, the resin sealing member 13 is disposed such that the outer circumferential rim 56*a* of the ring-shaped portion 56 of the stator core 51 is exposed upward. Accordingly, for insert molding, the die is provided with first contact portions contactable with the axial end surfaces 57*b* of the respective of the respective salient pole portions 57 from the upper side, and a second contact portion contactable with the outer circumferential rim of the ring-shaped portion 56 from the upper side. The first contact portions and the second contact portion are brought into contact with the stator core 51 and thereby the stator core 51 can be positioned in the Z-axis direction. In other words, in the embodiment, in a state where the stator core 51 arranged in the die is positioned in the radial direction and in the Z-axis direction, resin is injected into the die and thereby the resin sealing member 13 can be formed. Consequently, accuracy of a relative position between the stator core 51 and the resin sealing member 13 is increased.

In addition, the cut portions 87 provided in the inner circumferential surface of the sealing member cylindrical portion 67 are traces of the first contact portions provided in the die. In other words, the first contact portions provided in the die are brought into contact with the axial end surfaces 57*b* of the respective salient pole portions 57 in the Z-axis direction for insert molding. Thus, when the BMC is solidified to form the resin sealing member 13, portions with which the first contact portions are in contact are eventually formed as the exposed portion 57*c* and the portions in which the first contact portions are located are eventually formed as the cut portions 87.

(Cover Member)

Figure 10:
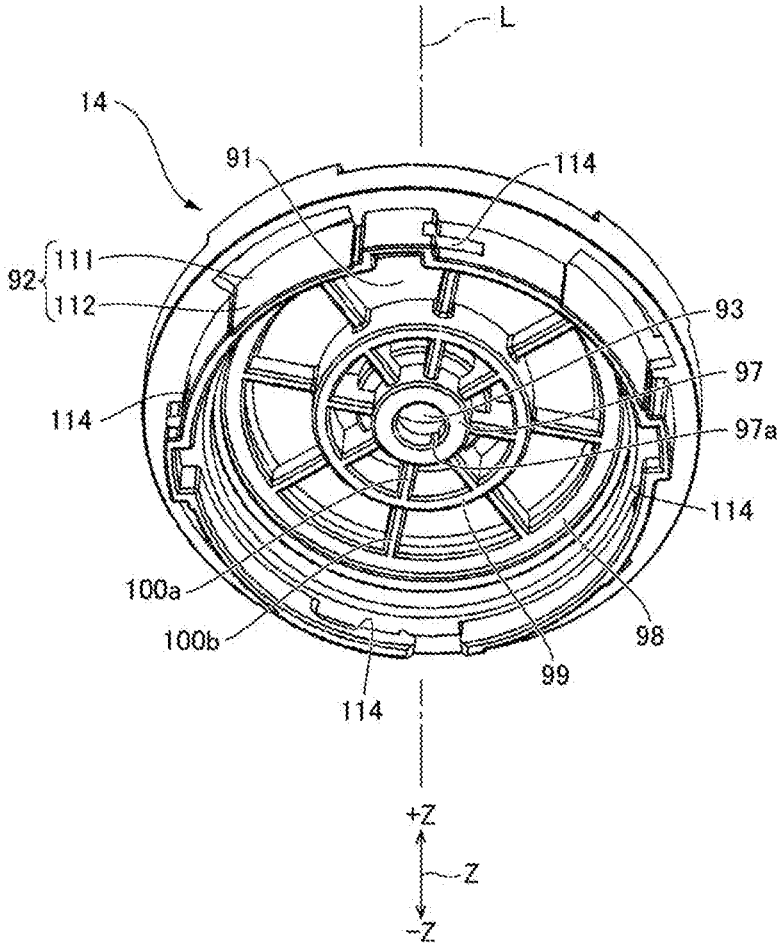
FIG. 10 is a perspective view of the cover member.

FIG. 10 is a perspective view of the cover member 14 when viewed from the upper side. The cover member 14 made of resin is fixed on the upper side of the resin sealing member 13.

As illustrated in FIGS. 6 and 10, the cover member 14 includes a cover member ceiling portion 91 having a circular plate shape, and a cover member cylindrical portion 92 extending from the cover member ceiling portion 91 toward the negative side in the Z-axis direction. The cover member ceiling portion 91 includes a through hole 93 extending through the center in the Z-axis direction. As illustrated in FIGS. 2 and 6, a circular recess 94 surrounding the through hole 93 is provided in the center of an upper surface of the cover member ceiling portion 91. A ring-shaped sealing member 95 is arranged in the circular recess 94. The output shaft 2 extends through the sealing member 95.

As illustrated in FIG. 6, an inner ring-shaped protrusion 101 is provided on an opening rim of the circular recess 94 of the cover member 14. An outer ring-shaped protrusion 102 is provided on the cover member 14 to be located radially outward of the inner ring-shaped protrusion 101. A flat inner ring-shaped surface 103 (facing surface) perpendicular to the axis line L is provided between the inner ring-shaped protrusion 101 and the outer ring-shaped protrusion 102. The protruding length of the outer ring-shaped protrusion 102 from the inner ring-shaped surface 103 is greater than the protruding length of the inner ring-shaped protrusion 101 from the inner ring-shaped surface 103. A first step portion 107 and a second step portion 108 are provided on an outer circumferential surface of the outer ring-shaped protrusion 102. As illustrated in FIG. 2, an O-ring 109 is attached to the first step portion 107 located at the upper side of the second step portion 108.

As illustrated in FIG. 6, an outer ring-shaped surface 104 is provided on the cover member 14 to be located radially outward of the outer ring-shaped protrusion 102. A ring-shaped protrusion 105 is provided radially outward of the outer ring-shaped surface 104. Four engagement pawls 106 protruding radially inward are circumferentially provided at a tip end portion of the ring-shaped protrusion 105. The outer circumferential side of the outer ring-shaped protrusion 102 of the cover member 14 corresponds to a case body attachment portion for attaching the case body 5 to the motor 3 (the cover member 14).

As illustrated in FIG. 10, a bearing member holding cylindrical portion 97 coaxial with the through hole 93 is provided in the center of a lower surface of the cover member ceiling portion 91. Further, an outer ring-shaped rib 98 is provided on the lower surface of the cover member ceiling portion 91 to extend along a circular outer periphery of the cover member ceiling portion 91. Furthermore, an inner ring-shaped rib 99 is provided on the lower surface of the cover member ceiling portion 91 to be located between the bearing member holding cylindrical portion 97 and the outer ring-shaped rib 98. Inner ribs 100*a* extending radially from the bearing member holding cylindrical portion 97 to the inner ring-shaped rib 99 are provided between the bearing member holding cylindrical portion 97 and the inner ring-shaped rib 99. Outer ribs 100*b* extending radially from the inner ring-shaped rib 99 to the outer ring-shaped rib 98 are provided between the inner ring-shaped rib 99 and the outer ring-shaped rib 98. The bearing member holding cylindrical portion 97, the outer ring-shaped rib 98, and the inner ring-shaped rib 99 are coaxially disposed. A lower end surface of the bearing member holding cylindrical portion 97, a lower end surface of the outer ring-shaped rib 98, and a lower end surface of the inner ring-shaped rib 99 are flat surfaces perpendicular to the axis line L. The amount of protrusion of the bearing member holding cylindrical portion 97 from the lower surface of the cover member ceiling portion 91 is larger than the amount of protrusion of the inner ring-shaped rib 99 from the lower surface of the cover member ceiling portion 91. The amount of protrusion of the inner ring-shaped rib 99 from the lower surface of the cover member ceiling portion 91 is larger than the amount of protrusion of the outer ring-shaped rib 98 from the lower surface of the cover member ceiling portion 91. Lower surfaces of the outer ribs 100*b* and a lower surface of the outer ring-shaped rib 98 are located on the same plane.

As illustrated in FIG. 10, the bearing member holding cylindrical portion 97 is provided with a groove 97*a* that is provided in a circumferential portion of an inner circumferential wall of the through hole 93 to extend in the Z-axis direction. As illustrated in FIG. 2, the second bearing member 16 is held in a center hole of the bearing member holding cylindrical portion 97.

Here, as illustrated in FIG. 2, the second bearing member 16 is arranged in such a way that the same member as the first bearing member 15 is disposed in a vertically reversed manner. The second bearing member 16 made of resin includes a cylindrical support portion 70 having a through hole through which the output shaft 2 extends, and a flange portion 71 extending radially outward from a lower end of the support portion 70. A protruded portion 70*a* extending with a constant width in the Z-axis direction is formed in a circumferential portion of an outer circumferential surface of the support portion 70. When viewed in the Z-axis direction, the outline of the flange portion 71 has a D-shape provided with a circular arc outline portion 71*a* of a circular arc shape and a linear outline portion 71*b* linearly connecting one circumferential end of the circular arc outline portion 71*a* to the other circumferential end of the circular arc outline portion 71*a*. The linear outline portion 71*b* is located on the opposite side of the through hole from the protruded portion 70*a*.

The support portion 70 of the second bearing member 16 is inserted into the bearing member holding cylindrical portion 97 in a state where the protruded portion 70*a* of the support portion 70 is aligned with the position of the groove 97*a* of the bearing member holding cylindrical portion 97. Then, as illustrated in FIG. 2, the second bearing member 16 is inserted until the flange portion 71 is brought into contact with the cover member 14 (a lower surface of the bearing member holding cylindrical portion 97 of the cover member ceiling portion 91) from the lower side, therefore being fixed to the bearing member holding cylindrical portion 97. In a state where the second bearing member 16 is fixed to the bearing member holding cylindrical portion 97, an upper end surface of the flange portion 71 is perpendicular to the axis line L. Here, the support portion 70 function as a radial bearing for the output shaft 2, and the flange portion 71 functions as a thrust bearing for the rotor 10. In other words, a lower end surface of the flange portion 71 is a sliding surface 72 with which the rotor 10 is slidably contactable. The sliding surface 72 of the second bearing member 16 is slidably contactable with the upper surface of the second bearing plate 46 fixed to the holding member 21 of the rotor 10. In other words, the upper surface of the second bearing plate 46 is the rotor-side sliding surface 46*a* slidably contactable with the sliding surface 72 of the second bearing member 16. In addition, grease is applied to the sliding surface 72.

As illustrated in FIG. 10, the cover member cylindrical portion 92 is located radially outward of the outer ring-shaped rib 98 to extend toward the negative side in the Z-axis direction. The cover member cylindrical portion 92 includes an upper ring-shaped cylindrical portion 111 that is overlapped with the small-diameter cylindrical portion 82 of the resin sealing member 13 to cover the small-diameter cylindrical portion 82 from the radially outer side, and a lower ring-shaped cylindrical portion 112 that is located below the upper ring-shaped cylindrical portion 111 and radially outward of the large-diameter cylindrical portion 81. As shown in FIG. 2, a ring-shaped step portion 113 is provided on an inner circumferential surface of the cover member cylindrical portion 92 to be located between the upper ring-shaped cylindrical portion 111 and the lower ring-shaped cylindrical portion 112. The ring-shaped step portion 113 is provided with a ring-shaped surface 113*a* facing downward. The ring-shaped surface 113*a* is a flat surface perpendicular to the axis line L. Four engaged portions 114 to be engaged with the engagement projections 85 of the resin sealing member 13 are circumferentially provided on the lower ring-shaped cylindrical portion 112.

Here, the resin sealing member 13 is covered from the upper side by the cover member 14 in a state where the rotor 10 is arranged within the resin sealing member 13 and the rotor 10 is supported by the first bearing member 15. To cover the resin sealing member 13 by the cover member 14, an adhesive is applied to an outer circumferential edge of an upper surface of the resin sealing member 13.

To cover the resin sealing member 13 by the cover member 14, a lower end portion of the inner ring-shaped rib 99 is fitted into the inner circumferential side of the sealing member cylindrical portion 67 of the resin sealing member 13 as illustrated in FIG. 2. Thus, the cover member 14 and the resin sealing member 13 are positioned to each other in the radial direction and the axis line L of the output shaft 2 coincides with the central axis line of the stator 11. In addition, the ring-shaped surface 113*a* of the ring-shaped step portion 113 of the cover member cylindrical portion 92 is brought into contact with the ring-shaped end surface 84 between the large-diameter cylindrical portion 81 and the small-diameter cylindrical portion 82 of the resin sealing member 13. Therefore, the cover member 14 and the resin sealing member 13 are positioned to each other in the Z-axis direction. Afterward, the cover member 14 and the resin sealing member 13 are relatively rotated circumferentially and thereby the engagement projections 85 of the resin sealing member 13 are engaged with the engaged portions 114 of the cover member 14. Consequently, the cover member ceiling portion 91 covers the rotor 10 and the resin sealing member 13 from the upper side in a state where the output shaft 2 extends through the cover member ceiling portion 91 in the Z-axis direction. Further, a clearance between the output shaft 2 and the cover member 14 and a clearance between the output shaft 2 and the second bearing member 16 are sealed with the sealing member 95 arranged in the circular recess 94 of the cover member ceiling portion 91. Furthermore, the upper ring-shaped cylindrical portion 111 of the cover member cylindrical portion 92 is disposed to surround the small-diameter cylindrical portion 82 of the resin sealing member 13 from the radially outer side.

(Impeller)

Figure 11A:
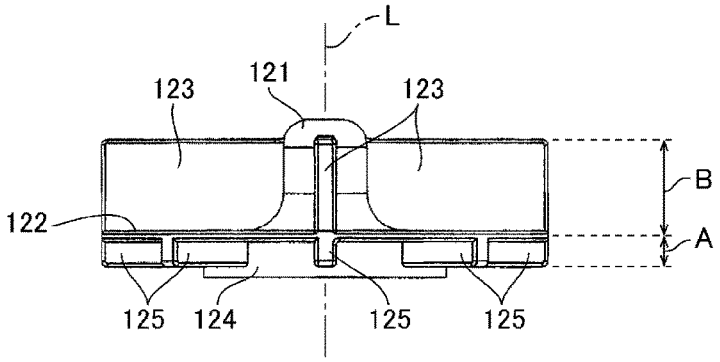
FIGS. 11A, 11B, and 11C are respectively a side view, a plan view, and a bottom view of the impeller.
Figure 11B:
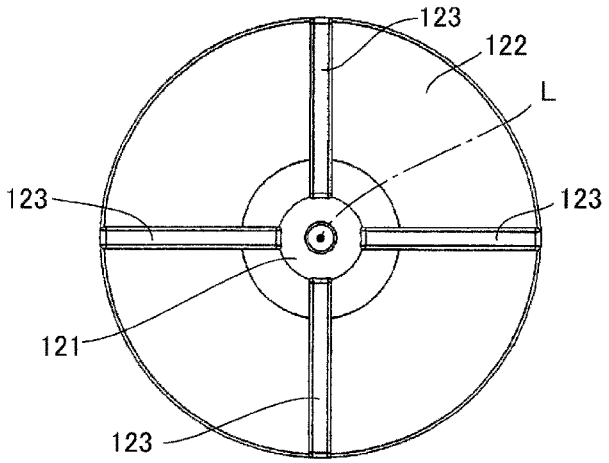
Figure 11C:
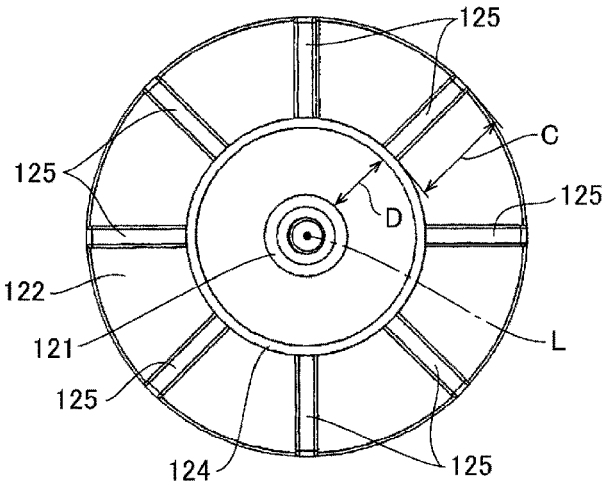

FIG. 11A is a side view of the impeller. FIG. 11B is a plan view of the impeller when viewed from the positive side in the Z-axis direction. FIG. 11C is a bottom view of the impeller when viewed from the negative side in the Z-axis direction. As illustrated in FIGS. 4 and 11A to 11C, the impeller 7 includes a cylindrical portion 121 having a center hole in which the output shaft 2 of the motor 3 is to be inserted and a shroud 122 extending from a lower side of the cylindrical portion 121 in a direction perpendicular to the axis line L. The shroud 122 extends radially outward from a halfway position of the cylindrical portion 121 in the Z-axis direction (from a position closer to the lower side of the cylindrical portion 121 than the center thereof in the Z-axis direction). An upper end portion of the center hole of the cylindrical portion 121 is closed. In the embodiment, the shroud 122 has a circular outline.

Further, the impeller 7 is provided with four front blades 123 on an end surface of an upper side of the shroud 122 (on the opposite side of the end wall portion 4 of the motor 3). The four front blades 123 protrude upward from the shroud 122 and extend in a radial direction perpendicular to the axis line L. Each of the front blades 123 is formed substantially in a rectangle shape when viewed circumferentially. A radially inner end of the front blade 123 is continuously formed with the cylindrical portion 121. A radially outer end of the front blade 123 extends up to an outer circumferential edge of the shroud 122. The four front blades 123 are provided at equal angular intervals around the axis line L. In other words, the four front blades 123 are radially provided at an angular interval of 90 degrees. The amount of protrusion of each of the front blades 123 from the shroud 122 is radially constant. Therefore, an upper end of the front blade 123 extends in parallel with the shroud 122.

Furthermore, as illustrated in FIGS. 5 and 11A to 11C, the impeller 7, on the lower side of the shroud 122 (on a side adjacent to the end wall portion 4 of the motor 3), a ring-shaped rib 124 coaxially surrounding the cylindrical portion 121 and eight back blades 125. The eight back blades 125 protrude downward from the shroud 122 and extend in a radial direction perpendicular to the axis line L. Each of the back blades 125 is formed substantially in a rectangle shape when viewed circumferentially. A radially inner end of the back blade 125 is continuously formed with the ring-shaped rib 124. A radially outer end of the back blade 125 extends up to the outer circumferential edge of the shroud 122. The eight back blades 125 are provided at equal angular intervals around the axis line L. In other words, the eight back blades 125 are radially provided at an angular interval of 45 degrees. Further, of the eight back blades 125, the four back blades 125 alternately arranged are provided at the same angular position as the front blades 123. Accordingly, the four back blades 125 are overlapped with the front blades 123 when viewed in the Z-axis direction. The amount of protrusion of each of the back blades 125 from the shroud 122 is radially constant. Therefore, a lower end of the back blade 125 extends in parallel with the shroud 122. As illustrated in FIG. 11A, a protrusion amount A of the back blade 125 from the shroud 122 (a height of the back blade 125) is equal to or smaller than one-third of a protrusion amount B of the front blade 123 (a height of the front blade 123) from the shroud 122.

Here, the protrusion amount A of the back blade 125 from the shroud 122 is smaller than the amount of protrusion of the ring-shaped rib 124 from the shroud 122. The amount of protrusion of the cylindrical portion 121 from the shroud 122 (the amount of protrusion of a portion of the cylindrical portion 121, which extends from the shroud 122 toward the negative side in the Z-axis direction) is smaller than the amount of protrusion of the ring-shaped rib 124 and larger than the protrusion amount A of the back blade 125. Also, as illustrated in FIG. 11C, a length dimension C from an outer circumferential surface of the ring-shaped rib 124 to the radially outer end in the back blade 125 (a length dimension of the back blade 125) is equal to or greater than a distance D between the cylindrical portion 121 and the ring-shaped rib 124.

(Case Body and Pump Chamber)

Next, as illustrated in FIG. 3, the case body 5 is provided from the lower side to the upper side with a large-diameter ring-shaped fixation portion 131, a small-diameter ring-shaped fixation portion 132 having an outer diameter smaller than an outer diameter of the large-diameter ring-shaped fixation portion 131, a cylindrical body portion 133 coaxial with the large-diameter ring-shaped fixation portion 131 and the small-diameter ring-shaped fixation portion 132 and having an outer diameter smaller than the outer diameter of the small-diameter ring-shaped fixation portion 132, a ring-shaped plate portion 134 having an annular shape and extending radially inward from an upper end of the cylindrical body portion 133, and an inlet pipe 135 extending coaxially with the cylindrical body portion 133 from the center of the ring-shaped plate portion 134. Further, the case body 5 is provided with an outlet pipe 136 extending radially outward from a circumferential portion of the cylindrical body portion 133. The outlet pipe 136 is communicated with the inside of the cylindrical body portion 133. An upper end opening of the inlet pipe 135 is the fluid inlet port 8, and a tip end opening of the outlet pipe 136 is the fluid outlet port 9. Four protruded portions 137 protruding radially outward are circumferentially provided on the large-diameter ring-shaped fixation portion 131.

After the impeller 7 is attached to a tip end portion of the output shaft 2, the case body 5 is fixed to the cover member 14 of the motor 3. To fix the case body 5 to the cover member 14, as illustrated in FIGS. 2 and 3, the outer ring-shaped protrusion 102 of the cover member 14 with the O-ring 109 fitted is inserted into the radially inner side of the large-diameter ring-shaped fixation portion 131 and the small-diameter ring-shaped fixation portion 132. Then, the outer ring-shaped surface 104 of the cover member 14 is brought into contact with a lower end surface of the large-diameter ring-shaped fixation portion 131. Thereafter, the case body 5 is circumferentially rotated and thereby the protruded portions 137 are engaged with the engagement pawls 106 of the cover member 14. Thus, the case body 5 is fixed to the cover member 14 with the O-ring 109 radially interposed between the case body 5 and the cover member 14.

When the case body 5 is fixed to the cover member 14, the pump chamber 6 is defined between the cover member 14 and the case body 5 as illustrated in FIG. 2. Therefore, the impeller 7 is arranged in the pump chamber 6.

Here, in a state where the case body 5 is fixed to the cover member 14, an inner circumferential surface of the outer ring-shaped protrusion 102 of the cover member 14 is continuously formed with an inner circumferential surface of the cylindrical body portion 133 of the case body 5, therefore configuring a circumferential wall surface 6*a* of the pump chamber 6. An inner surface of the ring-shaped plate portion 134 configures a ceiling surface 6*b* (a case body side facing surface) of the pump chamber 6. The ceiling surface 6*b* is perpendicular to the axis line L and in parallel with the inner ring-shaped surface 103. A radially inner area of the outer ring-shaped protrusion 102 of the cover member 14 configures a bottom surface 6*c* of the pump chamber 6. The fluid inlet port 8 of the pump chamber 6 is located coaxially with the axis line L of the output shaft 2 of the motor 3. The fluid outlet port 9 is provided outward in a radial direction perpendicularly to the axis line L of the output shaft 2. When the motor 3 is driven to rotate the impeller 7, the fluid is sucked from the fluid inlet port 8 to be discharged from the fluid outlet port 9. Here, the inner ring-shaped surface 103 of the cover member 14 is a ring-shaped facing surface overlapping a rotation trajectory of the back blades 125 when viewed in the Z-axis direction. The inner ring-shaped surface 103 is a flat surface perpendicular to the axis line L and in parallel with the back blades 125.

(Suction Power Generation Mechanism)

Figure 12:
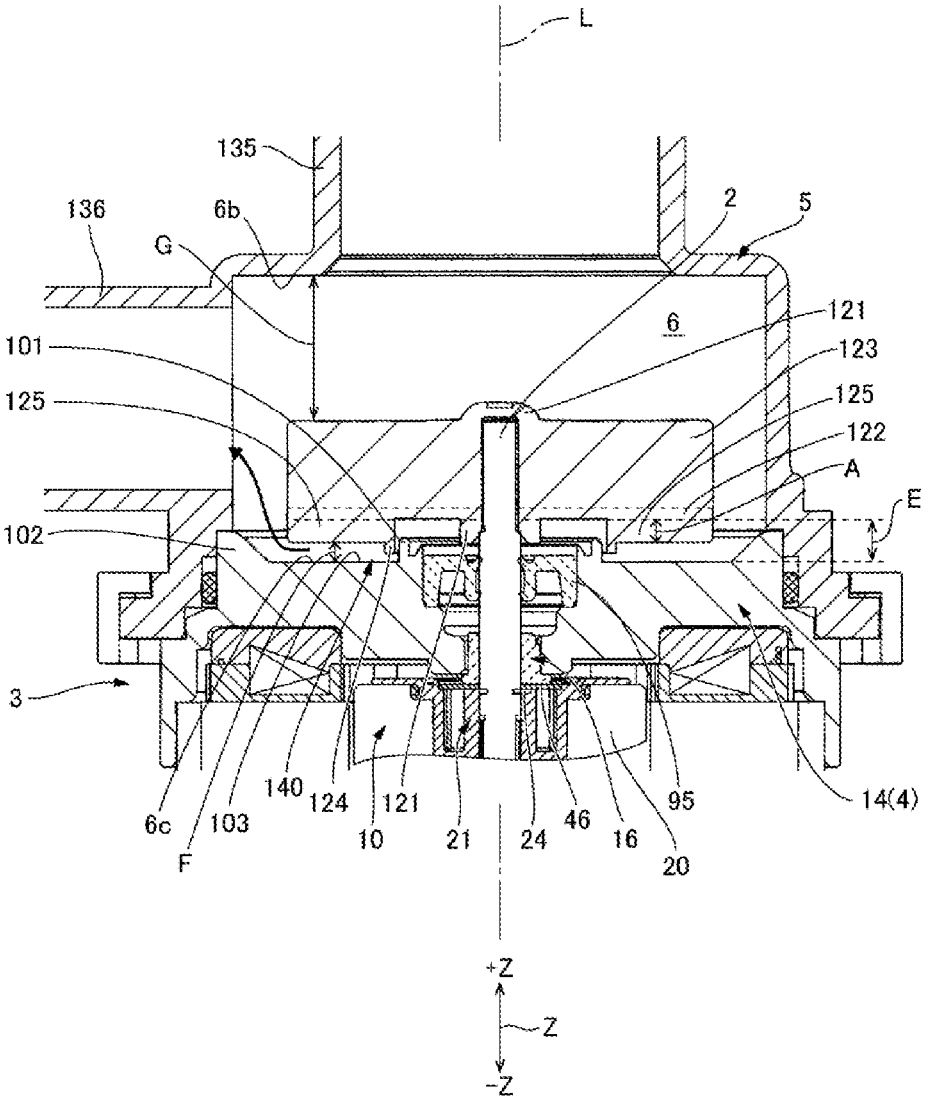
FIG. 12 is a partial enlarged cross-sectional view of the surroundings of a pump chamber.
Figure 13:
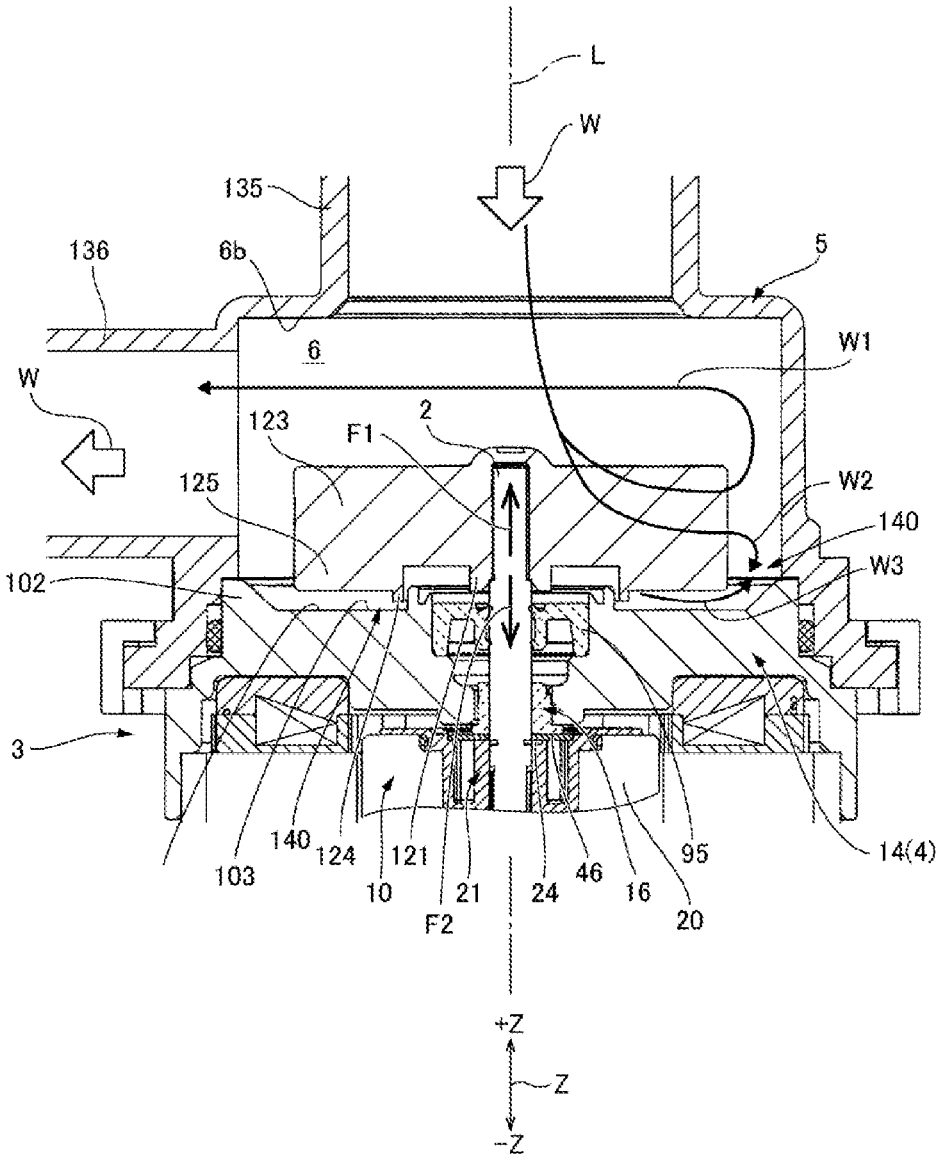
FIG. 13 is an explanatory drawing of a suction power generation mechanism.

FIG. 12 is a partial enlarged cross-sectional view of the surroundings of the pump chamber 6. FIG. 13 is an explanatory drawing of a suction power generation mechanism. As illustrated in FIG. 13, when the motor 3 is driven to rotate the impeller 7, a fluid W flows from the fluid inlet port 8 toward the front blades 123 of the impeller 7 and circulates through the pump chamber 6 to be discharged from the fluid outlet port 9.

A portion W1 of the fluid W circulating through the pump chamber 6 is drawn radially outward of the impeller 7 by the front blades 123, thereafter flowing through a clearance between the impeller 7 and the case body 5 toward the fluid outlet port 9. Also, another portion W2 of the fluid W circulating through the pump chamber 6 is drawn radially outward of the impeller 7 by the front blades 123, thereafter flowing through a clearance between the impeller 7 and the end wall portion 4 (the cover member 14) of the motor 3 toward the fluid outlet port 9.

Here, when the fluid W2 flows into the clearance between the impeller 7 and the end wall portion 4 of the motor 3, pressure between the impeller 7 and the end wall portion 4 increases. Therefore, a force F1 moving the impeller 7 toward the case body 5 acts on the impeller 7. Consequently, the impeller 7 is pressed toward the case body 5. When the impeller 7 is pressed toward the case body 5, the output shaft 2 to which the impeller 7 is connected is pressed toward the case body 5. Accordingly, the rotor 10 (the holding member 21) is pushed against the second bearing member 16. Therefore, high heat is generated between the output shaft 2 and the rotor 10 by a sliding movement. Consequently, in a case where the holding member 21 configuring the rotor 10 is made of resin or in a case where the cover member 14 by which the pump chamber 6 is defined is made of resin, the resin members may be deformed by the generated heat.

For such a problem, in the embodiment, the impeller 7 includes the back blades 125 protruding from the shroud 122 toward the end wall portion 4 (the cover member 14) of the motor 3. In the embodiment, the impeller 7 includes the back blades 125, and thereby the force F1 moving the impeller 7 toward the case body 5 can be inhibited and the impeller 7 can be sucked toward the end wall portion 4 of the motor 3.

In other words, when the fluid W circulates through the pump chamber 6, a fluid W3 is drawn out by the back blades 125 radially outward through the clearance between the impeller 7 and the end wall portion 4 of the motor 3. Here, as illustrated in FIG. 13, the fluid W3 drawn out by the back blades 125 radially outward through the clearance between the impeller 7 and the end wall portion 4 is brought into collision with the fluid W2 drawn out by the front blades 123 radially outward of the impeller 7 to subsequently flow into the clearance between the impeller 7 and the end wall portion 4 of the motor 3. Thus, since the fluid W2 is inhibited from flowing into the clearance between the impeller 7 and the end wall portion 4, pressure between the impeller 7 and the end wall portion 4 is inhibited from increasing. As a result, the force F1 moving the impeller 7 toward the case body 5 decreases.

In addition, when the fluid W3 is drawn out by the back blades 125 radially outward through the clearance between the impeller 7 and the end wall portion 4 of the motor 3, a negative pressure F2 is generated between the impeller 7 and the end wall portion 4 of the motor 3. Therefore, the impeller 7 is sucked toward the end wall portion 4 of the motor 3 by the negative pressure F2. In other words, the back blades 125 of the impeller 7 function as a suction power generation mechanism 140 that is configured to generate suction power (the negative pressure F2) sucking the impeller 7 toward the end wall portion 4 when the motor 3 is driven to rotate the impeller 7, and the fluid W is flowing from the fluid inlet port 8 toward the fluid outlet port 9 through the pump chamber 6.

Here, as illustrated in FIG. 12, the protrusion amount A of the back blade 125 is equal to or greater than 50% of a separate distance between the shroud 122 and the inner ring-shaped surface 103 of the cover member 14. Therefore, a first distance F between the back blade 125 and the end wall portion 4 of the motor 3 (the inner ring-shaped surface 103) can be reduced. Consequently, the fluid W3 can be easily drawn out by the back blades 125 from the clearance between the impeller 7 and the end wall portion 4 of the motor 3. As a result, the force F1 moving the impeller 7 toward the case body 5 is easily inhibited and the negative pressure F2 is easily generated. In addition, if the protrusion amount A of the back blade 125 is further increased, a larger suction power (the negative pressure F2) can be generated.

Further, the first distance F between the back blade 125 and the inner ring-shaped surface 103 of the cover member 14 is smaller than a second distance G between the ceiling surface 6*b* facing the inner ring-shaped surface 103 of the cover member 14 in the Z-axis direction (a lower surface of the ring-shaped plate portion 134 of the case body 5) and the front blade 123. In other words, a distance between the back blade 125 and the end wall portion 4 of the motor 3 is smaller than a distance between the front blade 123 and the case body 5. Therefore, the fluid W3 is easily drawn out from the clearance between the back blades 125 and the end wall portion 4 of the motor 3 and the negative pressure F2 is easily generated. Furthermore, the number of back blades 125 is larger than the number of front blades 123; therefore, the fluid W3 is easily drawn out from the clearance between the impeller 7 and the end wall portion 4 of the motor 3. Consequently, the force F1 moving the impeller 7 toward the case body 5 is easily inhibited and the negative pressure F2 is easily generated.

Moreover, the impeller 7 includes the cylindrical portion 121 protruding from the shroud 122 toward the end wall portion 4 and the ring-shaped rib 124. Therefore, the impeller 7 can be held, by the output shaft 2 extending through the cylindrical portion 121, so as not to be inclined. Further, dusts or the like included in the fluid W can be prevented or inhibited by the ring-shaped rib 124 from reaching the surroundings of the output shaft 2. Furthermore, the length dimension from the outer circumferential surface of the ring-shaped rib 124 to the radially outer end of the back blade 125 is equal or greater than the distance between the cylindrical portion 121 and the ring-shaped rib 124. Thus, the radial length dimension of the back blade 125 can be secured. Therefore, the fluid W3 can be easily drawn out by the back blades 125 from the clearance between the impeller 7 and the end wall portion 4 of the motor 3.

Advantageous Effects

The pump device 1 according to the embodiment is configured such that the impeller 7 includes the back blades 125. Accordingly, when the impeller 7 is driven by the motor 3, and the fluid W is flowing from the fluid inlet port 8 toward the fluid outlet port 9 through the pump chamber 6, the fluid W3 can be drawn out from the clearance between the impeller 7 and the end wall portion 4 of the motor 3. Therefore, even when a portion W2 of the fluid W circulating through the pump chamber 6 flows into the clearance between the impeller 7 and the end wall portion 4 of the motor 3 and the force F1 moving the impeller 7 toward the case body 5 acts, the force F1 can be inhibited. Further, the back blades 125 function as the suction power generation mechanism 140 configured to generate suction power (the negative force F2) sucking the impeller 7 toward the end wall portion 4. Therefore, when the fluid W circulates through the pump chamber 6, the impeller 7 can be inhibited from being pressed toward the case body 5. Consequently, since the output shaft 2 to which the impeller 7 is connected can be inhibited from being pressed toward the case body 5, the rotor 10 provided with the output shaft 2 in the motor 3 can be inhibited from being pressed against the second bearing member 16 slidably contacting with the rotor 10 from the output side. As a result, heat generated by a sliding movement of the rotor 10 with the second bearing member 16 can be inhibited.

Furthermore, in the embodiment, the resin holding member 21 holding the output shaft 2 from the radially outer side holds the E-ring 24 (the first metallic member) fixed to the output shaft 2 to protrude radially outward from the output shaft 2. Therefore, a position of the holding member 21 relative to the output shaft 2 can be prevented or inhibited from changing in the Z-axis direction. Consequently, since a position of the magnet 20 held by the holding member 21 can be prevented or inhibited from changing in the Z-axis direction, rotation accuracy of the rotor 10 can be maintained. Also, since the holding member 21 holds the E-ring 24 fixed to the output shaft 2, the heat generated by the sliding movement of the second bearing member 16 with the rotor 10 can be released via the E-ring 24 toward the output shaft 2. Therefore, the resin holding member 21 can be prevented or inhibited from being deformed by the heat generated by the sliding movement of the second bearing member 16 with the rotor 10.

Further, in the embodiment, the rotor 10 includes the metallic second bearing plate 46 (the second metallic member) held by the holding member 21, and the second bearing plate 46 includes the rotor-side sliding surface 46*a* slidably contactable with the sliding surface 72 of the second bearing member 16. Accordingly, a portion of the rotor 10, which is slidable with the second bearing member 16 is made of metal and therefore is not deformed by the heat generated by the sliding movement. Furthermore, the E-ring 24 fixed to the output shaft 2 is in contact with the second bearing plate 46 from the opposite side of the sliding surface 72. Therefore, at the time of rotation of the rotor 10, force pressing the rotor 10 toward the second bearing member 16 acts and thereby the second bearing plate 46 is pressed against the second bearing member 16. Even in such a state, the position of the second bearing plate 46 does not change in a direction to separate from the sliding surface 72 in the Z-axis direction. Therefore, the position of the rotor 10 can be prevented from changing in the Z-axis direction.

Moreover, since the E-ring 24 is brought into contact with the second bearing plate 46, the heat generated by the sliding movement of the second bearing member 16 with the rotor 10 is released via the E-ring 24 toward the output shaft 2. Here, the output shaft 2 is made of metal. Therefore, the heat generated by the sliding movement of the rotor 10 with the second bearing member 16 is easily released via the output shaft 2.

In addition, the second bearing plate 46 is held by the holding member 21 in a state where the output shaft 2 extends through the center hole 48 of the second bearing plate 46, and the second bearing plate 46 is not fixed to the output shaft 2. Therefore, deformation of the second bearing plate 46 due to fixation to the output shaft 2 can be avoided. Consequently, since flatness of the rotor-side sliding surface 46*a* can be maintained, the rotation accuracy of the rotor 10 is easily secured.

MODIFIED EXAMPLES

In addition, the number of back blades 125 is not limited to the aforementioned example and may be decreased or increased. In such a case, the number of back blades 125 is increased; therefore, the fluid W3 can be further drawn out by the back blades 125 from the clearance between the impeller 7 and the end wall portion 4 of the motor 3. Thus, the force F1 moving the impeller 7 toward the case body 5 can be easily inhibited, and the suction power (the negative fore F2) generated between the impeller 7 and the end wall portion 4 of the motor 3 can be increased. Further, a diameter of the ring-shaped rib 124 of the impeller 7 may be changed from that in the aforementioned example and the radial length dimension C of the back blade 125 may be changed. In such a case, if the radial length dimension C of the back blade 125 is increased, the fluid W3 is easily and further drawn out from the clearance between the impeller 7 and the end wall portion 4 of the motor 3. Thus, the force F1 moving the impeller 7 toward the case body 5 can be easily inhibited and the suction power (the negative force F2) generated between the impeller 7 and the end wall portion 4 of the motor 3 can be increased.

Furthermore, in the aforementioned example, the back blade 125 radially extends linearly but may be inclined with respect to the radial direction. For example, the back blade 125 can be inclined such that the radially inner side is on the front side in the rotation direction and the radially outer side is on the back side in the rotation direction. Alternatively, the back blade 125 may be shaped into a circular arc.

The invention claimed is:

1. A pump device, comprising:

a motor, having an output shaft;

a case body, configured to cover an end wall portion located at an output side of the motor through which the output shaft extends;

a pump chamber defined by the end wall portion and the case body;

a fluid inlet port and an outlet port, configured in the case body to be communicated with the pump chamber;

an impeller attached to the output shaft to be arranged in the pump chamber; and a suction power generation mechanism configured to generate suction power sucking the impeller toward the end wall portion when the impeller is driven by the motor, and the fluid is flowing from the fluid inlet port toward the fluid outlet port through the pump chamber, wherein the motor includes a rotor configured with the output shaft, and a first bearing member and a second bearing member disposed in a mutually reversed manner supporting the output shaft so that the output shaft is rotatable, the rotor includes a first bearing plate having a first rotor-side sliding surface, the first bearing member includes a first sliding surface with which the first rotor-side sliding surface is slidably contactable from a side of the motor opposite to the output side in a direction of an axis line of the output shaft, wherein the rotor further includes a resin holding member holding the output shaft from a radially outer side, a magnet held by the holding member, a first metallic member fixed to the output shaft to extend from the output shaft toward the radially outer side and held by the holding member, and a second metallic member, wherein the first bearing plate is held at a lower end of the holding member, and the second metallic member is held at an upper end of the holding member and has a second rotor-side sliding surface slidably contactable with a second sliding surface of the second bearing member in a state where the first metallic member is in contact with the second metallic member from the opposite side of the output side, wherein grease is disposed on the first sliding surface and the second sliding surface.

2. The pump device according to claim 1, wherein the impeller includes a shroud extending in a direction intersecting with the axis line of the output shaft, a front blade protruding from the shroud toward the opposite side of the end wall portion, and a back blade protruding from the shroud toward the end wall portion, and the suction power generation mechanism includes the back blade.

3. The pump device according to claim 2, wherein the shroud extends perpendicularly to the axis line, the back blade is configured such that a protrusion amount from the shroud toward the end wall portion is constant in a radial direction, and a ring-shaped facing surface of the end wall portion overlapping a rotation trajectory of the back blade when viewed in the direction of the axis line is a flat surface in parallel with the back blade.

4. The pump device according to claim 3, wherein the protrusion amount of the back blade is equal to or greater than 50% of a separate distance between the shroud and the facing surface.

5. The pump device according to claim 3, wherein a first distance between the back blade and the facing surface is smaller than a second distance between the front blade and a case body side facing surface which faces the facing surface in the axis line in the case body.

6. The pump device according to claim 2, wherein a plurality of the back blades is configured at equal angular intervals around the axis line.

7. The pump device according to claim 2, wherein the impeller includes a cylindrical portion being coaxial with the axis line and protruding from the shroud toward the end wall portion, and a ring-shaped rib configured at a radially outer side of the cylindrical portion and coaxially with the cylindrical portion, the output shaft is inserted to extend through a center hole of the cylindrical portion, the back blade extends from an outer circumferential surface of the ring-shaped rib toward the radially outer side, and a length dimension from the outer circumferential surface of the ring-shaped rib to a radially outer end in the back blade is equal to or greater than a distance between the cylindrical portion and the ring-shaped rib.

8. The pump device according to claim 1, wherein the output shaft is made of metal.

* * * * *